United States Patent [19]

Matsuoka

[11] Patent Number: 4,970,858

[45] Date of Patent: Nov. 20, 1990

[54] AIR-FUEL RATIO FEEDBACK SYSTEM HAVING IMPROVED ACTIVATION DETERMINATION FOR AIR-FUEL RATIO SENSOR

[75] Inventor: Hiroki Matsuoka, Susono, Japan

[73] Assignee: Toyota Jidosha Kabushiki Kaisha, Japan

[21] Appl. No.: 329,391

[22] Filed: Mar. 27, 1989

[30] Foreign Application Priority Data

Mar. 30, 1988 [JP] Japan ..... 63-74786
Apr. 27, 1988 [JP] Japan ..... 63-102657

[51] Int. Cl.[5] ..... F02D 41/14

[52] U.S. Cl. ..... 60/274; 60/276; 60/285; 123/489

[58] Field of Search ..... 123/440, 489, 589, 479; 60/274, 276, 285

[56] References Cited

U.S. PATENT DOCUMENTS

| | | | |
|---|---|---|---|
| 3,938,075 | 2/1976 | Reddy | 123/479 |
| 3,939,654 | 2/1976 | Creps | 60/276 |
| 4,027,477 | 6/1977 | Storey | 60/276 |
| 4,106,450 | 8/1978 | Norimatsu et al. | 123/440 |
| 4,111,162 | 9/1978 | Norimatsu et al. | 123/489 |
| 4,127,088 | 11/1978 | Ezoe | 123/440 |
| 4,130,095 | 12/1978 | Bowler et al. | 123/440 |
| 4,155,335 | 5/1979 | Hosaka et al. | 123/489 |
| 4,177,787 | 12/1979 | Hattori et al. | 123/440 |
| 4,178,884 | 12/1979 | Norimatsu et al. | 123/489 |
| 4,202,301 | 5/1980 | Early et al. | 123/489 |
| 4,235,204 | 11/1980 | Rice | 123/440 |
| 4,244,340 | 1/1981 | Herth et al. | 123/440 |
| 4,251,989 | 2/1981 | Norimatsu et al. | 123/440 |
| 4,401,086 | 8/1983 | Miyagi | 123/489 |
| 4,462,373 | 7/1984 | Kanno | 123/489 |
| 4,475,517 | 10/1984 | Kobayashi et al. | 123/489 |
| 4,502,443 | 3/1985 | Hasegawa et al. | 123/440 |
| 4,528,957 | 7/1985 | Jundt et al. | 123/489 |
| 4,539,958 | 9/1985 | Ito et al. | 123/440 |
| 4,571,683 | 2/1986 | Kobayashi et al. | 364/431/08 |
| 4,651,400 | 12/1985 | Hattori | 123/478 |
| 4,693,076 | 9/1987 | Chujo et al. | 60/274 |
| 4,707,985 | 11/1987 | Nagai et al. | 60/274 |
| 4,712,373 | 12/1987 | Nagai et al. | 60/274 |
| 4,720,973 | 1/1988 | Katsuno | 60/274 |
| 4,739,614 | 4/1988 | Katsuno et al. | 60/274 |

FOREIGN PATENT DOCUMENTS

| | | |
|---|---|---|
| 51-47486 | 4/1976 | Japan . |
| 52-43030 | 4/1977 | Japan . |
| 52-102934 | 8/1977 | Japan . |
| 53-5332 | 1/1978 | Japan . |
| 53-103796 | 9/1978 | Japan . |
| 55-5417 | 1/1980 | Japan . |
| 55-37562 | 3/1980 | Japan . |
| 55-156228 | 12/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |

(List continued on next page.)

OTHER PUBLICATIONS

Gogi (Technical Report) No. 87-5098, Apr. 20,1987.

*Primary Examiner*—Andrew M. Dolinar
*Attorney, Agent, or Firm*—Oliff & Berridge

[57] ABSTRACT

In an air-fuel ratio feedback control system including at least one air-fuel ratio sensor downstream of or within a catalyst converter provided in an exhaust gas passage, an actual air-fuel ratio is controlled in accordance with the output of the air-fuel ratio sensor, which is supplied to a pull-up type input circuit. After the output of the pull-up type input circuit becomes lower than an activation control level, the determination of whether or not the air-fuel ratio sensor is activated is carried out by determining whether or not the output of the pull-up type input circuit is within an active region, depending on the base air-fuel ratio of the engine.

46 Claims, 31 Drawing Sheets

FOREIGN PATENT DOCUMENTS

| | | | |
|---|---|---|---|
| 58-135343 | 8/1983 | Japan . | |
| 58-150038 | 9/1983 | Japan . | |
| 58-150039 | 9/1983 | Japan . | |
| 58-152147 | 9/1983 | Japan . | |
| 59-32644 | 2/1984 | Japan . | |
| 59-206638 | 11/1984 | Japan . | |
| 60-1340 | 1/1985 | Japan . | |
| 60-26138 | 2/1985 | Japan . | |
| 60-45749 | 3/1985 | Japan | 123/489 |
| 60-53635 | 3/1985 | Japan . | |
| 61-34330 | 2/1986 | Japan . | |
| 61-53436 | 3/1986 | Japan . | |
| 61-232346 | 10/1986 | Japan . | |
| 62-153545 | 7/1987 | Japan . | |

| Fig. 9A | Fig. 9B | Fig. 9C |
|---|---|---|

LEAN
RICH
A/F
TDR
CDLY 0
t1
t2
t3
t4
t5
t6
t7
t8
TDL
A/F'
(F1)
TDR
(-TDL)

LEAN
RICH
TDR
KIR
FAF1

RSL
RSR
KIL

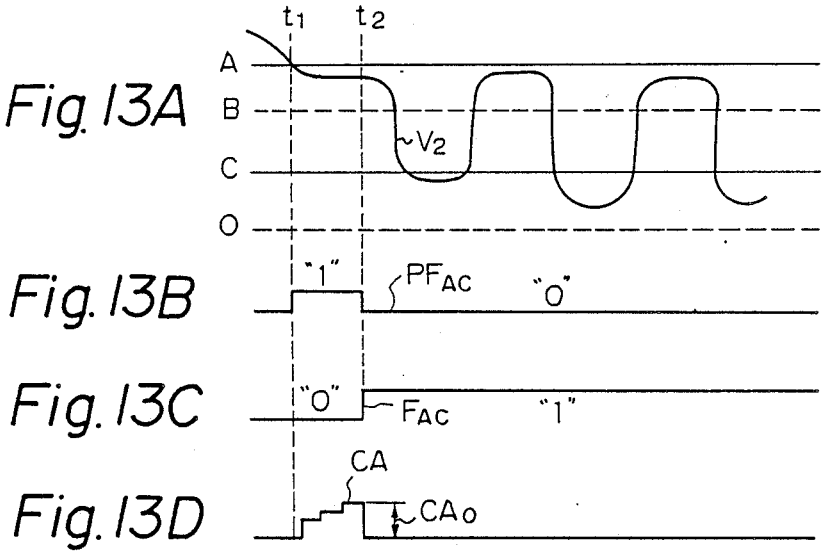
Fig. 13A
Fig. 13B
Fig. 13C
Fig. 13D
t1
t2
A
B
C
O
V2
"1"
PFAC
"0"
"0"
FAC
"1"
CA
CAo
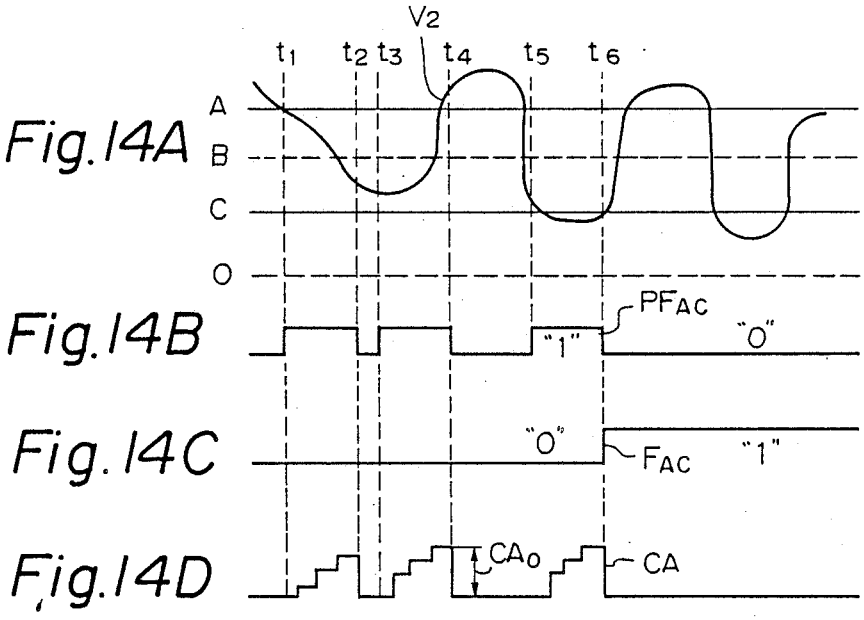
Fig. 14A
Fig. 14B
Fig. 14C
Fig. 14D
V2
t1
t2
t3
t4
t5
t6
A
B
C
O
PFAC
"1"
"0"
"0"
FAC
"1"
CAo
CA

| Fig. 20A | Fig. 20B |
|---|---|

| Fig. 26A | Fig. 26B |
|---|---|

AIR-FUEL RATIO FEEDBACK SYSTEM HAVING IMPROVED ACTIVATION DETERMINATION FOR AIR-FUEL RATIO SENSOR

BACKGROUND OF THE INVENTION (1) Field of the Invention

The present invention relates to method and apparatus for feedback control of an air-fuel ratio in an internal combustion engine having at least one air-fuel ratio sensor downstream of or within a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants, CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. No. 4,739,614). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons.

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

As input circuits for the outputs of the $O_2$ sensor, use is made of a pull-down type circuit and a pull-up type circuit. The pull-down type input circuit is disadvantageous in that determination of the activation of the $O_2$ sensor is impossible when the base air-fuel ratio is lean, which will be later explained in detail.

On the other hand, the pull-up input circuit is advantageous in that determination of the activation of the $O_2$ sensor is possible even when the base air-fuel ratio is lean, but is disadvantageous in that determination of the activation of the $O_2$ sensor is erroneously carried out, especially when the $O_2$ sensor is used as a downstream-side $O_2$ sensor in a double $O_2$ sensor system or as an $O_2$ sensor downstream of or within the catalyst converter in a single $O_2$ sensor system, which will be also later explained in detail. As a result, after the determination of the $O_2$ sensor, the air-fuel ratio may be erroneously controlled, thus reducing the emission characteristics, the fuel consumption characteristics, the drivability characteristics, and the like.

SUMMARY OF THE INVENTION

An object of the present invention is to provide a double air-fuel ratio sensor system and a single air-fuel ratio sensor system using a pull-up input circuit for an air-fuel ratio sensor downstream of or within a catalyst converter, whereby the emission characteristics, the fuel consumption characteristics the drivability characteristics, and the like are improved.

According to the present invention, an air-fuel ratio feedback control system including at least one air-fuel ratio sensor downstream of or within a catalyst converter provided in an exhaust gas passage, an actual air-fuel ratio is controlled in accordance with the output of the air-fuel ratio sensor, which is supplied to a pull-up type input circuit. After the output of the pull-up type input circuit becomes lower than an activation control level, the determination of whether or not the air-fuel ratio sensor is activated is carried out by determining whether or not the output of the pull-up type input circuit is within an active region, depending on the base air-fuel ratio of the engine.

BRIEF DESCRIPTION OF THE DRAWINGS

The present invention will be more clearly understood from the description as set forth below with reference to the accompanying drawings, wherein:

FIGS. 9A–9C, 12, 17, 18, 20, 20A, 20B, 22, 24, 24A, 24B, 25, 26, 26A, 26B and 27 flow charts shown the operation of the control circuit of FIG. 8;

FIG. 13A through 13D, and 14A through 14D are timing diagrams explaining the flow chart of FIG. 12;

DESCRIPTION OF THE PREFERRED EMBODIMENTS

Figure 1:
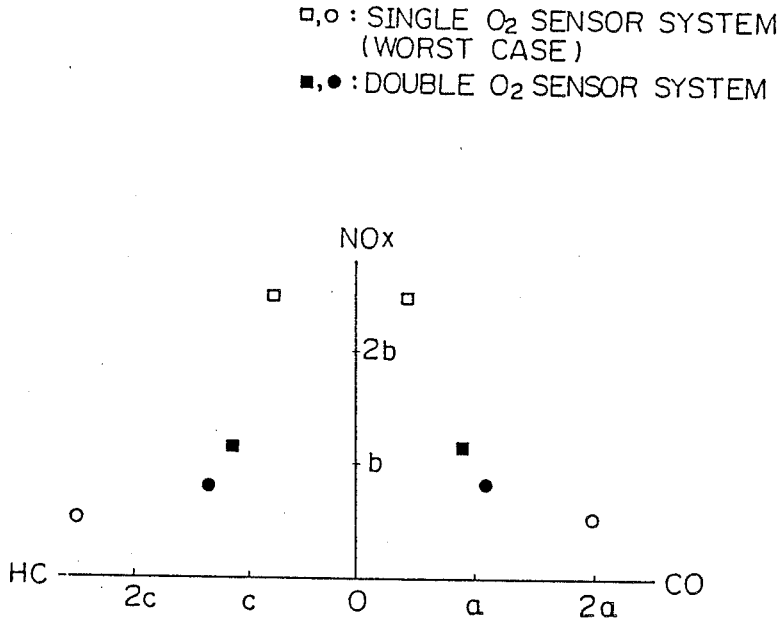
FIG. 1 is a graph showing the emission characteristics of a single $O_2$ sensor system and a double $O_2$ sensor system.
Figure 2:
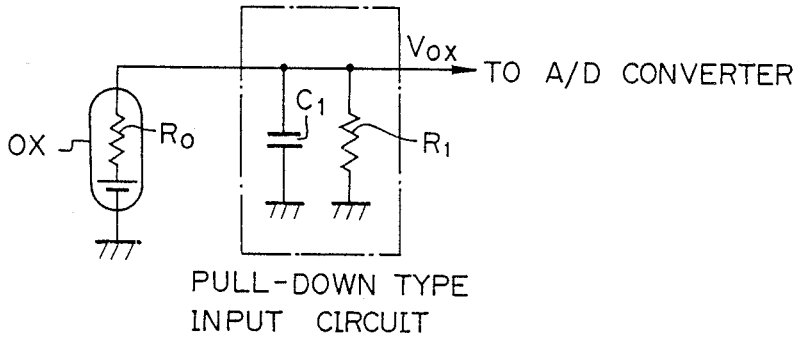
FIG. 2 is a circuit diagram illustrating an example of a pull-down type input circuit for an $O_2$ sensor.
Figure 3:
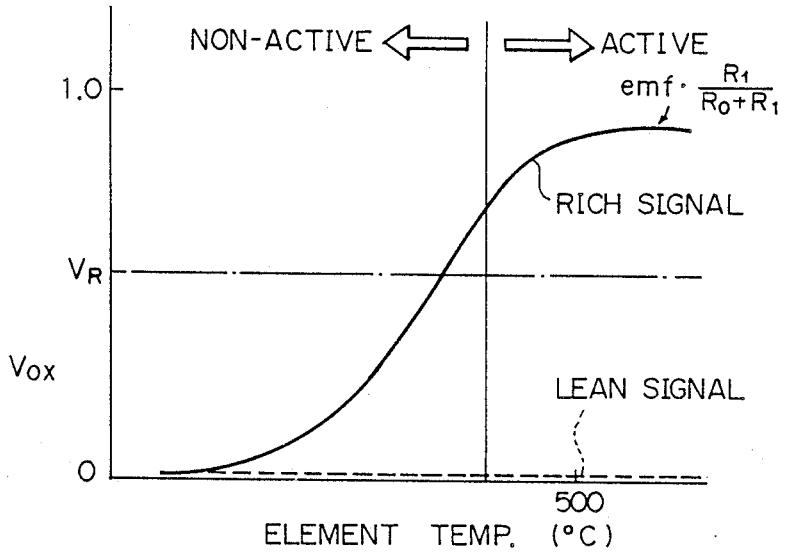
FIG. 3 is a diagram showing the output characteristics of the pull-down type input circuit of FIG. 2.

A pull-down type input circuit for the output of an $O_2$ sensor OX is illustrated in FIG. 2 (see: Kogi (Technical Report) No. 87-5098, Innovation Society, Japan, Apr. 20, 1987). This pull-down type input circuit is comprised of a pull-down resistor $R_1$ and a capacitor $C_1$ for absorbing the noise. As illustrated in FIG. 3, when the element temperature of the $O_2$ sensor OX is low, the internal resistance $R_0$ thereof is large, and as a result, even when the base air-fuel ratio is rich and the electromotive force of the $O_2$ sensor OX is large, the output $V_{OX}$ of the $O_2$ sensor OX is still low. On the other hand, as illustrated in FIG. 3, when the element temperature of the $O_2$ sensor OX is high, the internal resistance $R_0$ thereof is small, and as a result, when the base air-fuel ratio is rich, the output $V_{OX}$ of the $O_2$ sensor OX is at a high level defined by $$V_{OX}=emf\cdot R_1(R_0+R_1)$$

where emf is the electromotive force.

When use is made of the above-mentioned pull-down type input circuit for the output of the $O_2$ sensor, determination of the activation thereof is conventionally carried out by deciding whether or not the output $V_{OX}$ is higher than a predetermined value, or by deciding whether the output is swung, i.e., once changed from a low level to a high level or vice versa. In this case, however, when the base air-fuel ratio is lean, it cannot be determined that the $O_2$ sensor OX is activated, even when the $O_2$ sensor OX actually is activated.

Figure 4:
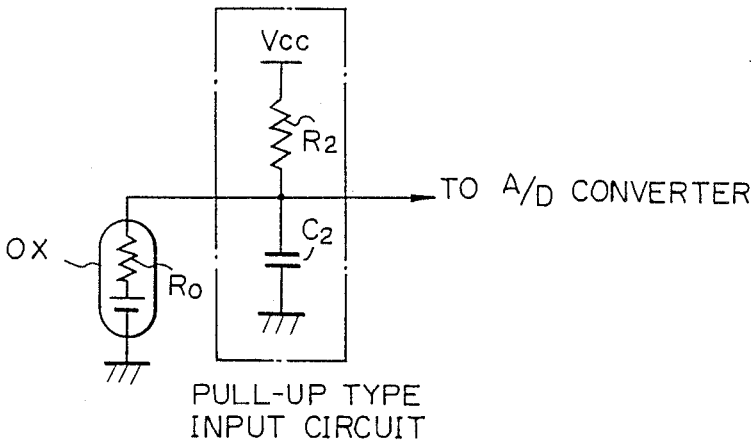
FIG. 4 is a circuit diagram illustrating an example of a pull-up type input circuit for an $O_2$ sensor.
Figure 5:
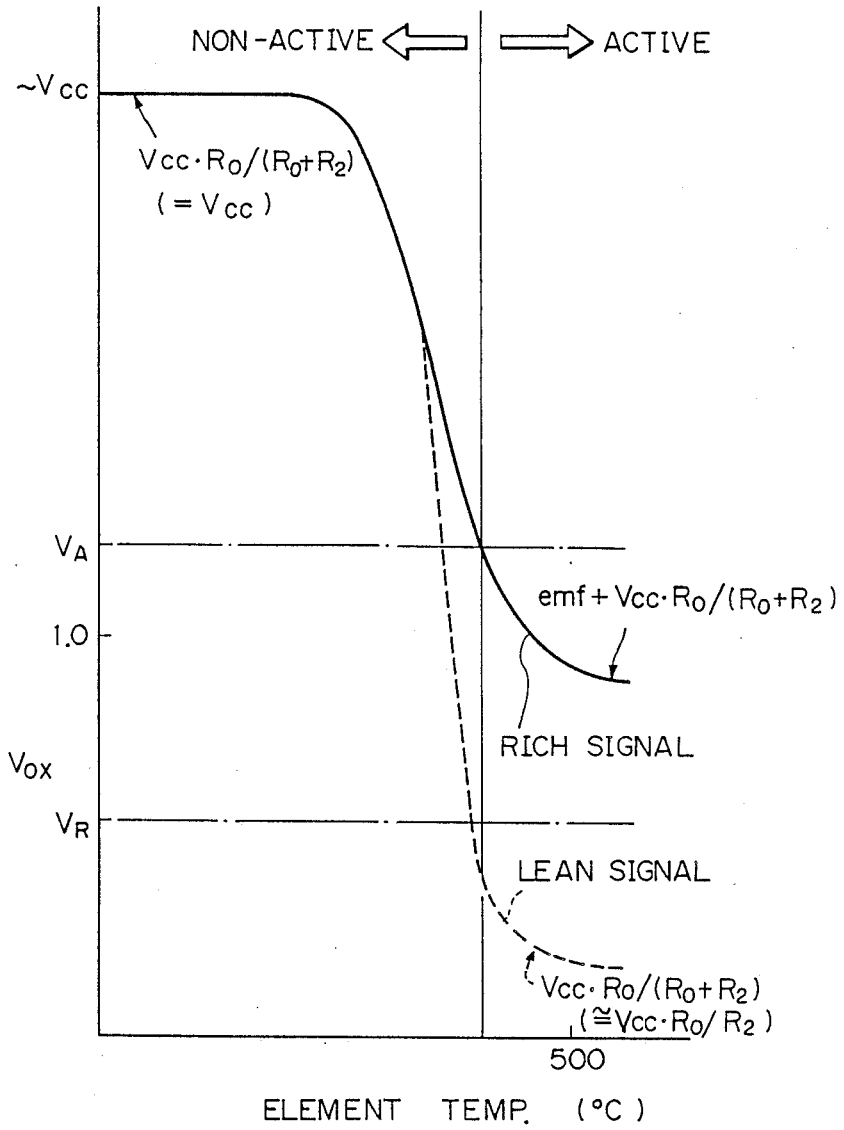
FIG. 5 is a diagram showing the output characteristics of the pull-up type input circuit of FIG. 4.

There is also known a pull-up type input circuit for the output $V_{OX}$ of the $O_2$ sensor OX as illustrated in FIG. 4, which enables a determination of the activation of the $O_2$ sensor regardless of the base air-fuel ratio (see also the above-mentioned Giho (Technical Report)). That is, this pull-up type input circuit is comprised of a pull-up resistor $R_2$ and a capacitor $C_2$ for absorbing the noise. When the element temperature thereof is low, the internal resistance of the $O_2$ sensor OX is large compared with the resistance of the resistor $R_2$, and as a result, regardless of the base air-fuel ratio the output $V_{OX}$ of the $O_2$ sensor OX is pulled up to a definite level close to a power supply voltage $V_{cc}$ as illustrated in FIG. 5. This definite level is defined by $$V_{cc}\cdot R_0/(R_0+R_2)\approx V_{cc}$$

On the other hand, when the element temperature of the $O_2$ sensor OX is high, the internal resistance $R_0$ thereof is small compared with that of the resistor $R_2$, and as a result, as illustrated in FIG. 5, when the base air-fuel ratio is rich, the output $V_{OX}$ of the $O_2$ sensor OX is $$emf+V_{cc}\cdot R_0/(R_0+R_2)\cdot$$

When the base air-fuel ratio is lean, the output $V_{OX}$ of the $O_2$ sensor OX is defined by $$V_{cc}\cdot R_0/(R_0+R_2)\cdot$$

Therefore, when use is made of the pull-up type input circuit for the output $V_{OX}$ of the $O_2$ sensor, determination of the activation of the $O_2$ sensor OX can be carried out by deciding whether or not the output $V_{OX}$ is higher than the activation determination level A, which is slightly higher than the rich output level of the $O_2$ sensor, after the engine is warmed-up.

Figure 6:
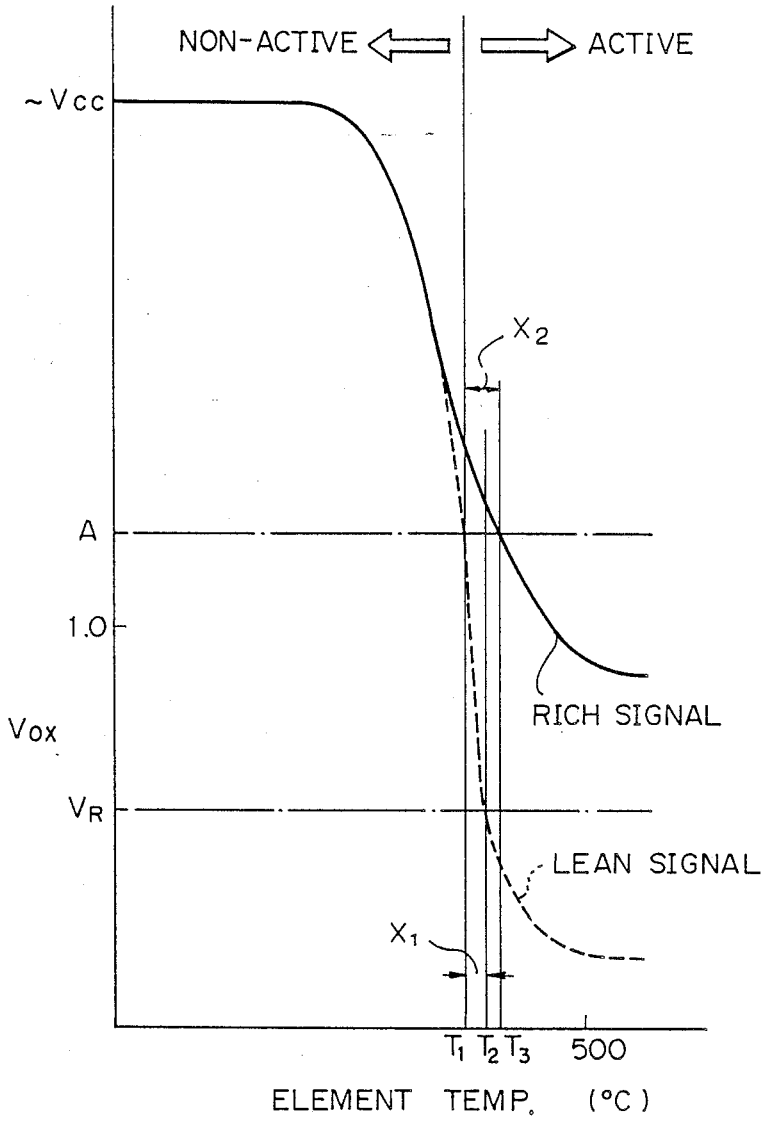
Fig. 6 PRIOR ART
FIGS. 6, 7A, and 7B are diagrams explaining the problems of the prior art activation determination system using a pull-up type input circuit.

In the above-mentioned double $O_2$ sensor system, however, when the above-mentioned pull-up type input circuit is applied to the downstream-side $O_2$ sensor, the following problems may occur. That is, since the activation determination level A is not variable in accordance with the base air-fuel ratio, the air-fuel ratio is erroneously controlled by the determination of a rich state immediately after the activation determination when the base air-fuel ratio is lean. Also, even thereafter, hunting of the determination of activation and non-activation by the switching of the base air-fuel ratio from the rich side to the lean side or vice versa may occur, thus causing the controlled air-fuel ratio to be on the rich side. Referring to FIG. 6, when the base air-fuel ratio is rich, a determination of the activation of the $O_2$ sensor is made at the element temperature $T_3$, and when the base air-fuel ratio is lean, determination of the activation of the $O_2$ sensor is made at the element temperature $T_1$ lower than $T_3$. In the latter case, the air-fuel ratio is erroneously determined to be rich as indicated by a range $X_1$ of the element temperature from $T_1$ to $T_2$, and as a result, the air-fuel ratio is erroneously controlled. Further, within a range $X_2$ of the element temperature from $T_1$ to $T_3$, the determination of activation and non-activation is in a hunting state in accordance with the base air-fuel ratio, thus creating an erroneous control of the air-fuel ratio.

Figure 7A:
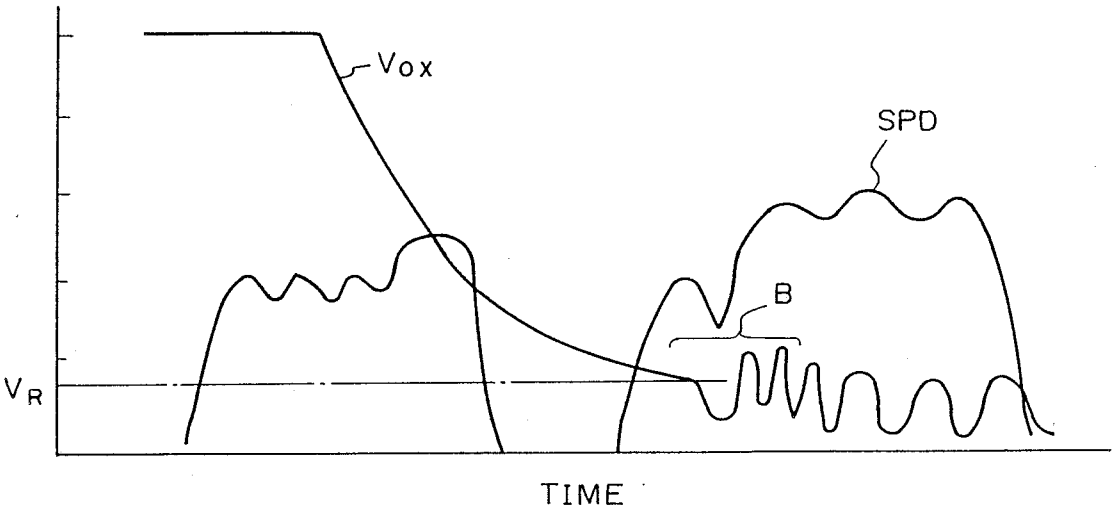
Figure 7B:
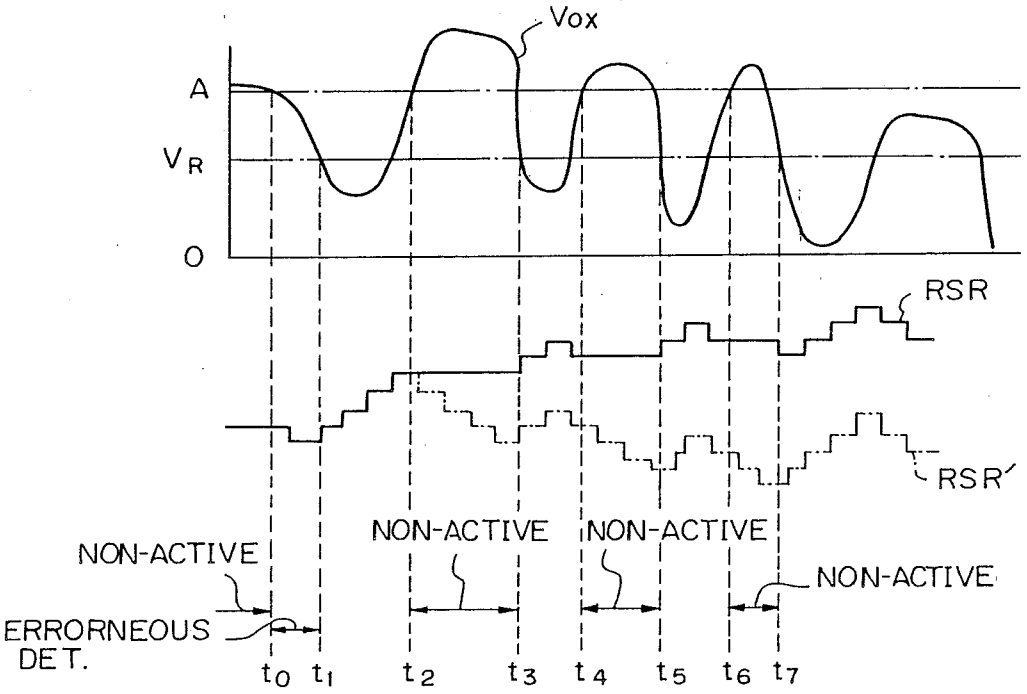

Further, referring to FIG. 7A and FIG. 7B, which is an enlargement of part B of FIG. 7A, at a time $t_0$ when the downstream-side $O_2$ sensor is determined to be in an activation state ($V_{OX}<A$) under the condition that the base air-fuel ratio is lean, an air-fuel ratio feedback control by the output of the downstream-side $O_2$ sensor is started to change a rich skip amount RSR, for example. In this case, since the air-fuel ratio is erroneously determined to be on the rich side ($V_{OX}>V_R$), the rich skip amount RSR is controlled to the lean side. After that, at time $t_1$, the rich skip amount RSR is normally controlled to the rich side. Also, at an initial stage where the downstream-side $O_2$ sensor is activated, the fluctuation of the base air-fuel ratio is large enough to invite frequent non-activation states of the downstream-side $O_2$ sensor from $t_2$ to $t_3$, from $t_4$ to $t_5$, and from $t_6$ to $t_7$ as illustrated in FIG. 7B. In these non-activation states of the downstream-side $O_2$ sensor, the renewal of the rich skip amount RSR is stopped, and thus the rich skip amount RSR is overcorrected to the rich side. Note that a dotted line RSR' indicates the rich skip amount where the overcorrection to the rich side does not occur.

Further, to avoid the above-mentioned hunting of the determination of activation and non-activation, it may be suggested that the activation determination level A is made high, but in this case, the term from $t_0$ to $t_1$ becomes long, thus further erroneously controlling the air-fuel ratio to the lean side. Also, the air-fuel ratio feedback control by the downstream side $O_2$ sensor may be often carried out at a semi-activation state of the downstream-side $O_2$ sensor, and thus it is impossible to increase the activation determination level A. Also, the inventor has already suggested that the determination of whether or not the air-fuel ratio sensor is activated be carried out by comparing the output of the pull-up type input circuit with two distinct levels, to thus obtain a hysteretic determination (see: U.S. Ser. No. 259336). The present invention is an improvement on this activation determination.

The above-mentioned problems will occur in a single $O_2$ sensor where an $O_2$ sensor is provided downstream of or within a catalyst converter.

Figure 8:
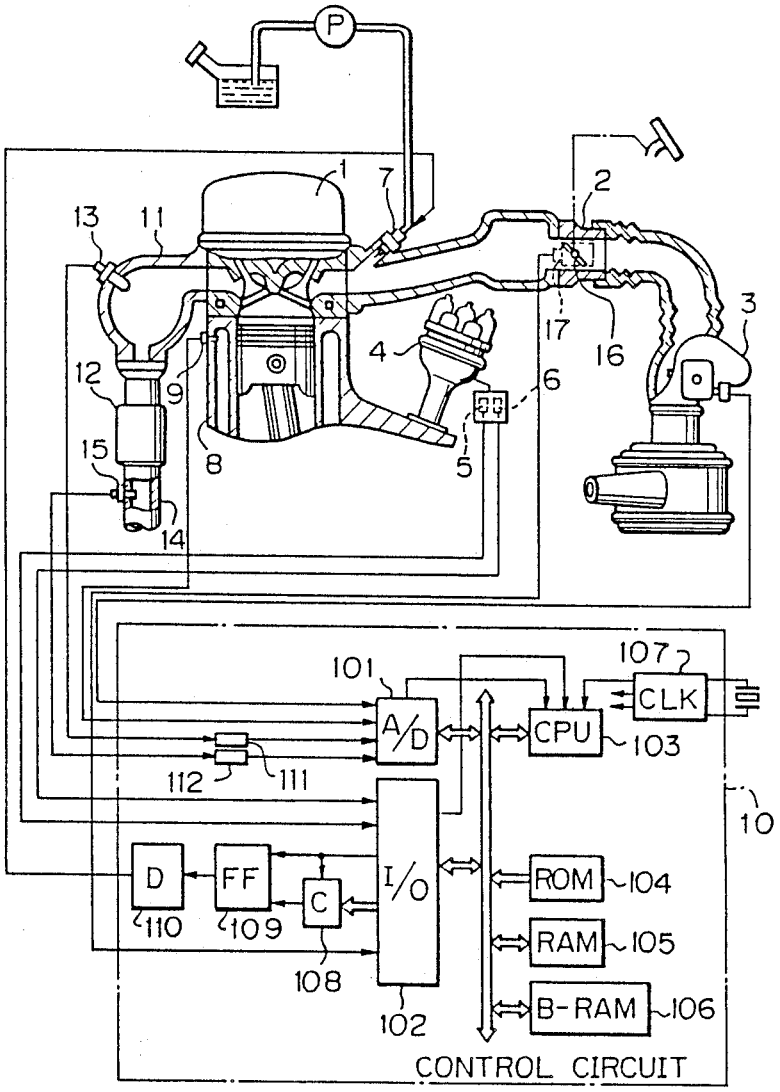
FIG. 8 is a schematic view of an internal combustion engine according to the present invention.

In FIG. 8, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 8.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals via pull-up type input circuits 111 and 112, respectively, to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the borrow-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s)

executed at predetermined intervals, and then stored in the RAM 105. That is, the data Q and THW in the RAM 105 are renewed at predetermined intervals. The engine speed Ne is calculated by an interrupt routine executed at 30° CA, i.e., at every pulse signal of the crank angle sensor 6, and is then stored in the RAM 105.

Figures 9, 9A:
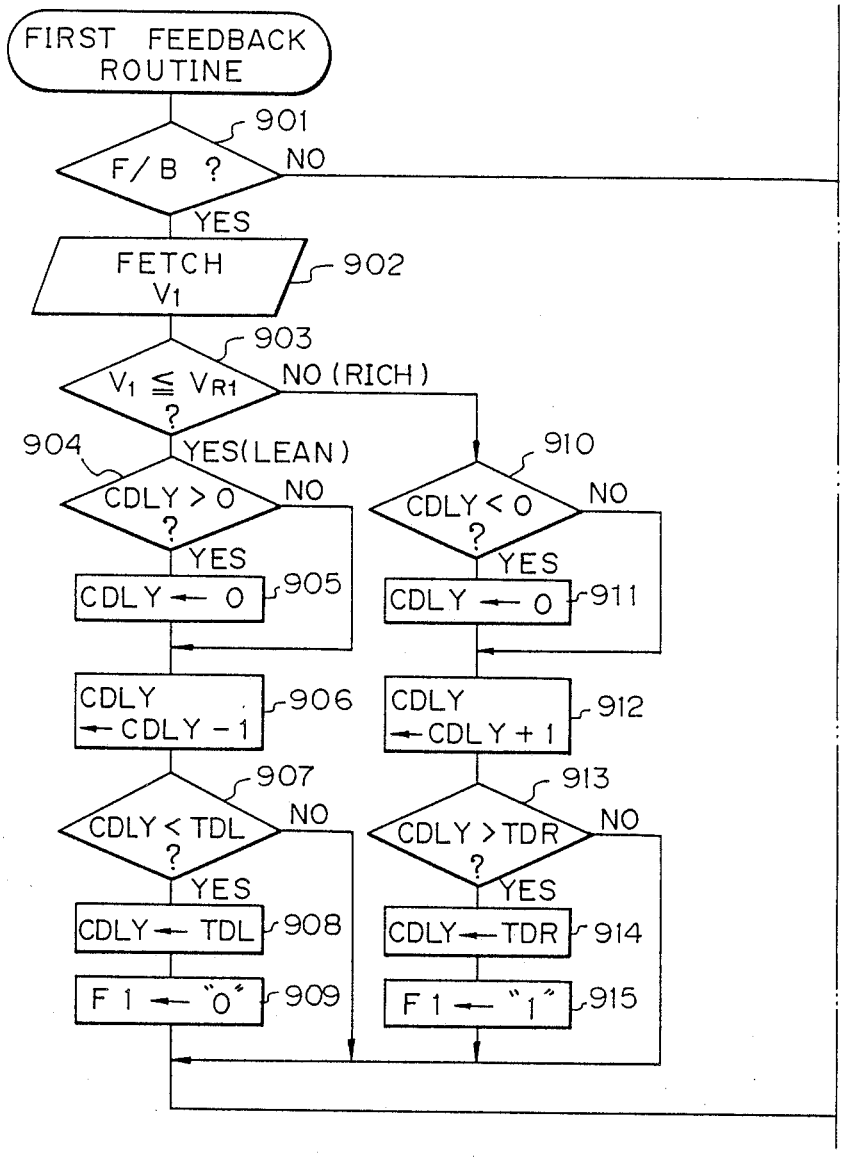
Figure 9B:
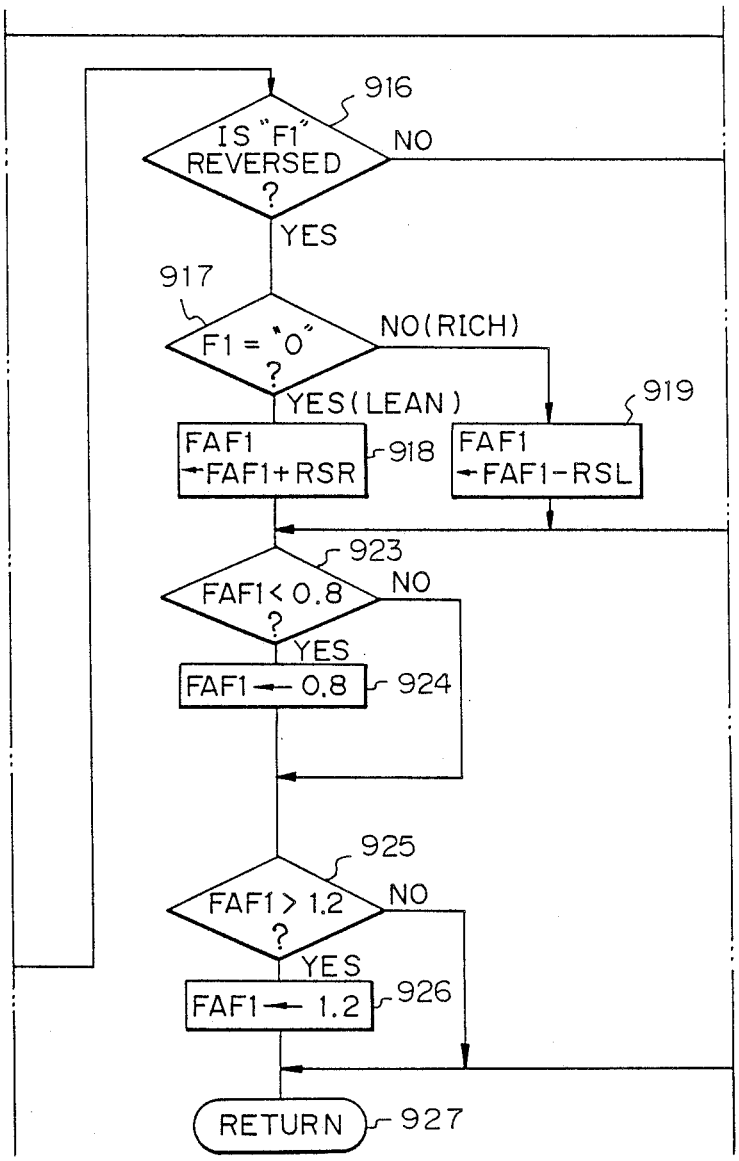
Figure 9C:
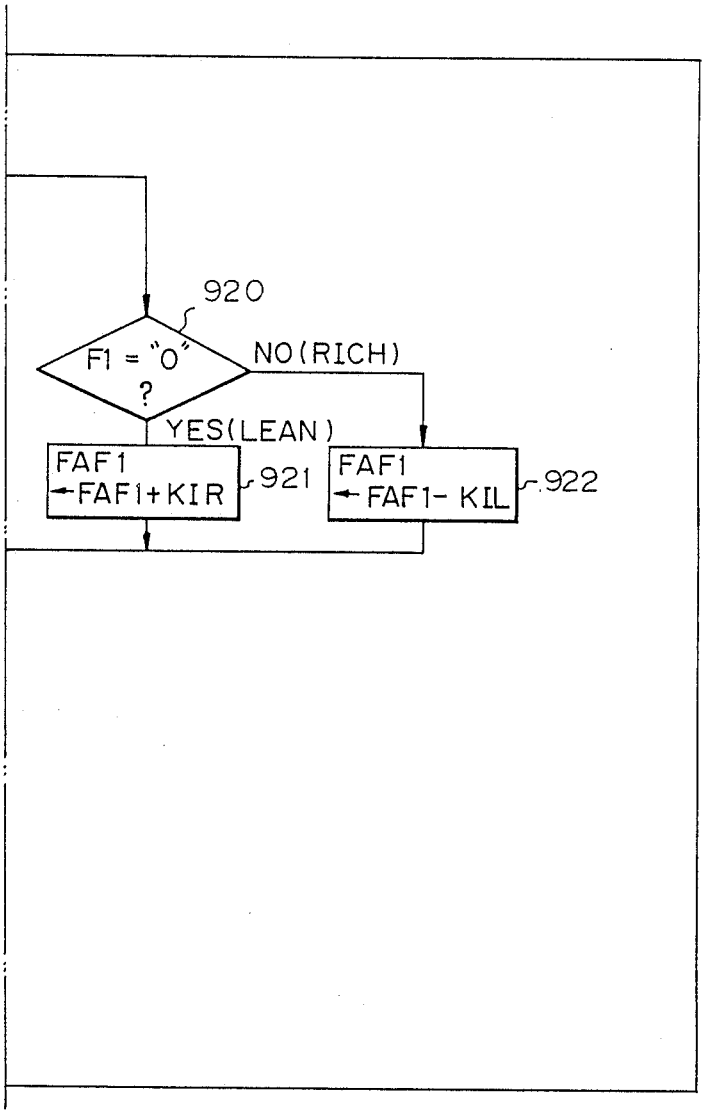

FIG. 9 is a routine for calculating a first air-fuel ratio feedback correction amount FAF1 in accordance with the output of the upstream-side $O_2$ sensor 13 executed at every predetermined time period such as 4 ms.

At step 901, it is determined whether or not all of the feedback control (closed-loop control) conditions by the upstream-side $O_2$ sensor 13 are satisfied. The feedback control conditions are as follows.

(i) the engine is not in a fuel cut-off state;
(ii) the engine is not in a starting state;
(iii) the coolant temperature THW is higher than 50° C.
(iv) the power fuel incremental amount FPOWER is 0; and
(v) the upstream-side $O_2$ sensor 13 is in an activated state Note that the determination of activation/non-activation of the upstream-side $O_2$ sensor 13 is carried out by determining whether or not the coolant temperature THW≧70° C., or by whether or not the output voltage $V_1$ of the upstream-side $O_2$ sensor 13, i.e., the output of the pull-up type input circuit 111, is lower than a predetermined value. Of course, other feedback control conditions are introduced as occasion demands, but an explanation of such other feedback control conditions is omitted.

If one of more of the feedback control conditions is not satisfied, the control proceeds to step 927, thereby carrying out an open-loop control operation. Note that, in this case, the amount FAF1 can be a value or a mean value immediately before the open-loop control operation. That is, the amount FAF1 or a mean value $\overline{FAF1}$ thereof is stored in the backup RAM 106, and in an open-loop control operation, the value FAF1 or $\overline{FAF1}$ is read out of the backup RAM 106.

Contrary to the above, at step 901, if all of the feedback control conditions are satisfied, the control proceeds to step 902.

At step 902, an A/D conversion is performed upon the output voltage $V_1$ of the upstream-side $O_2$ sensor 13, and the A/D converted value thereof is then fetched from the A/D converter 101. Then at step 903, the voltage $V_1$ is compared with a reference volta $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 904, which determines whether or not the value of a delay counter CDLY is positive. If CDLY>0, the control proceeds to step 905, which clears the delay counter CDLY, and then proceeds to step 906. If CDLY≦0, the control proceeds directly to step 906. At step 906, the delay counter CDLY is counted down by 1 and at step 907, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 907, only when CDLY<TDL does the control proceed to step 908, which causes CDLY to be TDL, and then to step 908, which causes a first air-fuel ratio flag F1 to be "0" (lean state). On the other hand, if $V_1 > V_{R1}$, which means that the current air-fuel ratio is rich, the control proceeds to step 910, which determines whether or not the value of the delay counter CDLY is negative. If CDLY>0, the control proceeds to step 911, which clears the delay counter CDLY, and then proceeds to step 912. If CDLY≧0, the control directly proceeds to 912. At step 912, the delay counter CDLY is counted up by 1, and at step 913, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 913, only when CDLY >TDR does the control proceed to step 914, which causes CDLY to be TDR, and then to step 915, which causes the first air-fuel ratio flag F1 to be "1" (rich state).

Next, at step 916, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 917 to 919, which carry out a skip operation.

At step 917, if the flag F1 is "0" (lean), the control proceeds to step 918, which remarkably increases the correction amount FAF1 by a skip amount RSR. Also, if the flag F1 is "1" (rich) at step 917, the control proceeds to step 919, which remarkably decreases the correction amount FAF1 by a skip amount RSL.

On the other hand, if the first air-fuel ratio flag F1 is not reversed at step 916, the control proceeds to steps 920 to 922, which carries out an integration operation. That is, if the flag F1 is "0" (lean) at step 920, the control proceeds to step 921, which gradually increases the correction amount FAF1 by a rich integration amount KIR. Also, if the flag F1 is "1" (rich) at step 920, the control proceeds to step 922 which gradually decreases the correction amount FAF1 by a lean integration amount KIL.

The correction amount FAF1 is guarded by a minimum value 0.8 at steps 923 and 924. Also, the correction amount FAF1 is guarded by a maximum value 1.2 at steps 925 and 926. Thus, the controlled air-fuel ratio is prevented from becoming overlean or overrich.

The correction amount FAF1 is then stored in the RAM 105, thus completing this routine of FIG. 9 at steps 928.

Figures 10A, 10B, 10C, 10D:
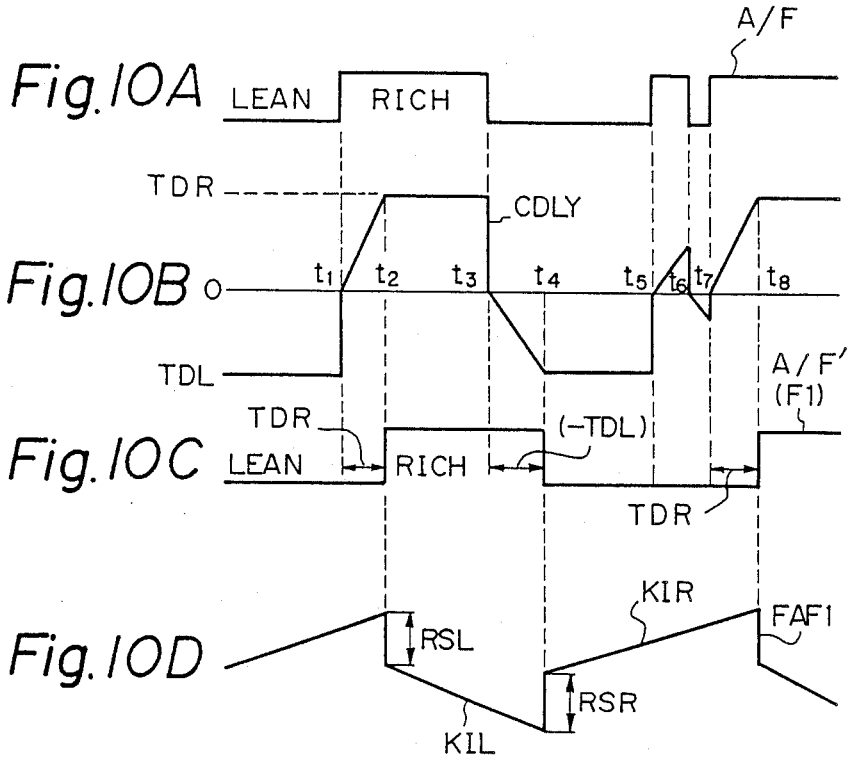
FIGS. 10A through 10D are timing diagrams explaining the flow chart of FIG. 9.

The operation by the flow chart of FIG. 9 will be further explained with reference to FIGS. 10A through 10D. As illustrated in FIG. 10A, when the air-fuel ratio A/F is obtained by the output $V_1$ of the upstream-side $O_2$ sensor 13, the delay counter CDLY is counted up during a rich state, and is counted down during a lean state, as illustrated in FIG. 10B. As a result, a delayed air-fuel ratio corresponding to the first air-fuel ratio flag F1 is obtained as illustrated in FIG. 10C. For example, at time $t_1$, even when the air-fuel ratio A/F is changed from the lean side to the rich side, the delayed air-fuel ratio A/F' (F1) is changed at time $t_2$ after the rich delay time period TDR. Similarly at time $t_3$, even when the air-fuel ratio A/F is changed from the rich side to the lean side, the delayed air-fuel ratio F1' is changed at time $t_4$ after the lean delay time period TDL. However, at time $t_5$, $t_6$, or $t_7$, when the air-fuel ratio A/F is reversed within a shorter time than the rich delay time TDR or the lean delay time TDL, the delay air-fuel ratio A/F' is reversed at time $t_8$. That is, the delayed air-fuel ratio A/F' is stable when compared with the air-fuel ratio A/F. Further, as illustrated in FIG. 10D, at every change of the delayed air-fuel ratio A/F' from the rich side to the lean side, or vice versa, the correction amount FAF1 is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto which an air-fuel ratio feedback control parameter in the air-fuel ratio feedback control operation by the upstream-side $O_2$ sensor 13 is variable. Further, as the air-fuel ratio feedback control parameter, there are nominated a delay time TD (in more detail, the rich delay time TDR and the lean delay time TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor. Also, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Further, if the rich delay time TDR becomes longer or if the lean delay time TDL becomes shorter, the controlled air-fuel becomes rich, and if the lean delay time TDL becomes longer or if the rich delay time TDL becomes shorter, the controlled air-fuel ratio becomes leaner. Thus, the air-fuel ratio can be controlled by changing the rich delay time TDR and the lean delay time (−TDL) in accordance with the output of the downstream-side $O_2$ sensor 15. Still further, if the reference volta is increased, the controlled air-fuel ratio becomes richer, and if the reference voltage $V_{R1}$ is decreased, the controlled air-fuel ratio becomes leaner. Thus, the air-fuel ratio can be controlled by changing the reference volta $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay times TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

Before describing a double $O_2$ sensor system, the determination of the activation of the downstream-side $O_2$ sensor 15 will be explained.

Figure 11:
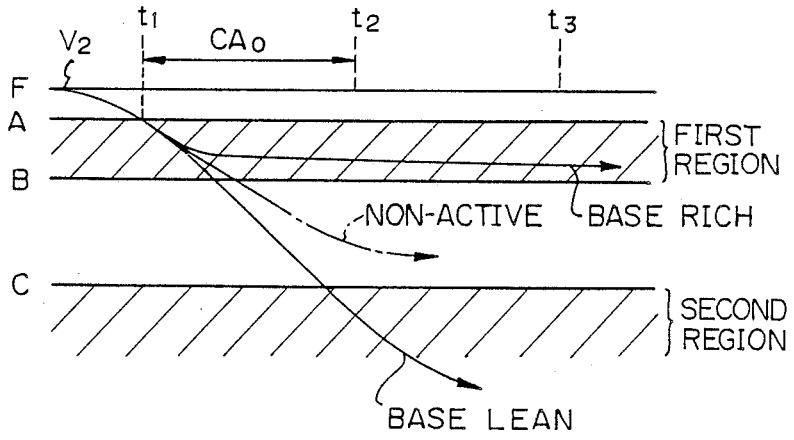
FIG. 11 is a timing diagram explaining the principle of a first embodiment of the present invention.

FIG. 11 is a timing diagram showing the principle of a first embodiment of the present invention. That is, after the downstream-side $O_2$ sensor 15 is activated, the output $V_2$ thereof becomes lower than an activation control level A. Subsequently, when the base air-fuel ratio is rich, the output $V_2$ is located within a first region (A−B). Conversely, when the base air-fuel ratio is lean, the output $V_2$ is located within a second region (less than C). Note that, if the downstream-side $O_2$ sensor 15 is not activated, the output $V_2$ thereof is not located within the first and second regions even after the output $V_2$ becomes lower than the activation control level A. Therefore, at a time $t_2$ at which a predetermined time $CA_0$ has elapsed after a time $t_1$at which the output $V_2$ reaches the activation control level A, the determination of the activation of the downstream-side $O_2$ sensor 15 can be carried out by determining whether or not the output $V_2$ is located within the first and second regions (A−B, C−). After the determination of the activation of the downstream-side $O_2$ sensor 15, an air-fuel ratio feedback control by the downstream-side $O_2$ sensor 15 is initiated. Note that a level F indicates a non-activation determination level.

Figure 12:
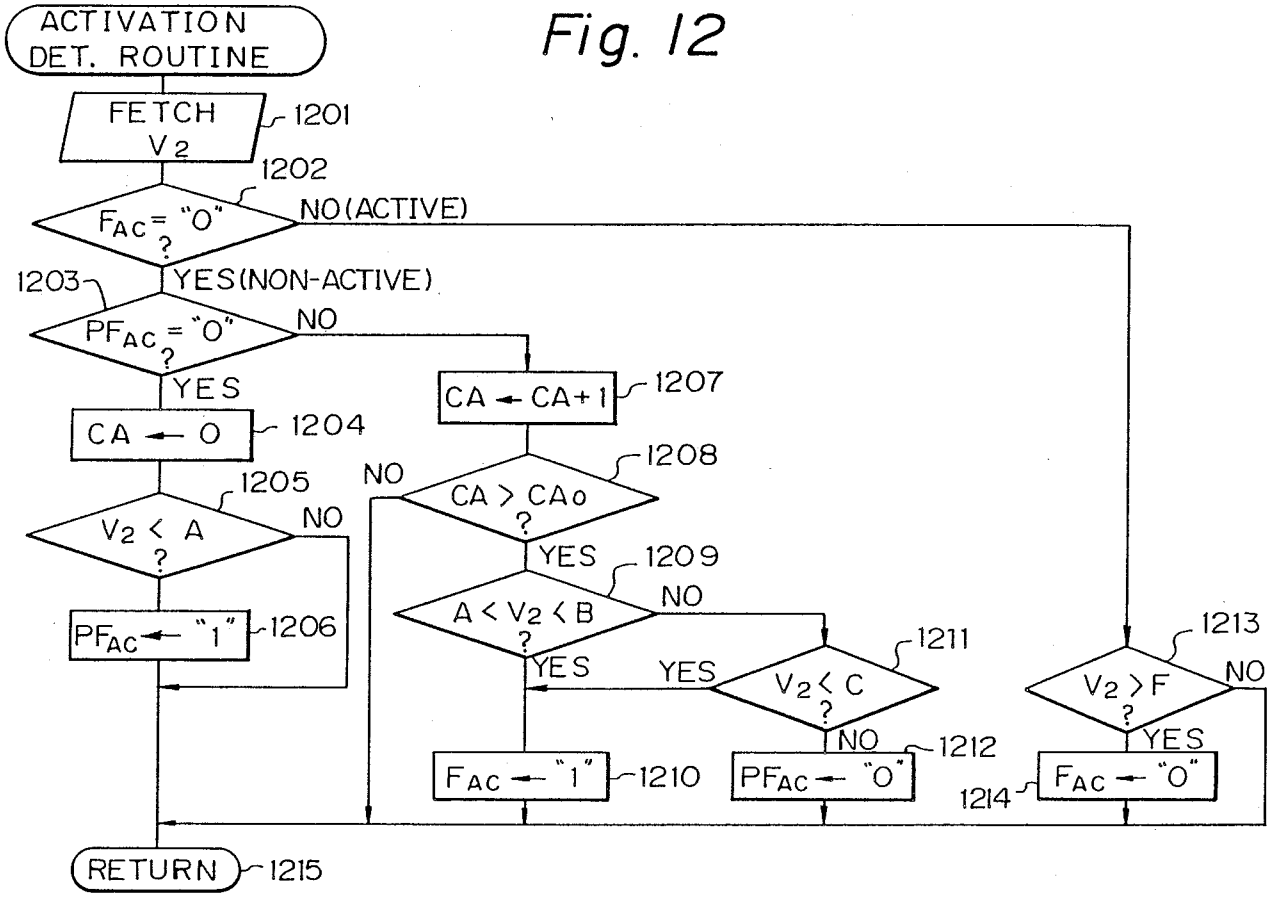

The principle of FIG. 11 is realized by a routine of FIG. 12 which is carried out at a predetermined interval such as 512 ms. The routine of FIG. 12 will be explained with reference to FIGS. 13A to 13D. In an initial state before the time $t_1$, the downstream-side $O_2$ sensor 15 is not activated, and therefore, a provisional activation flag $PF_{AC}$ and an activation flag $F_{AC}$ are both "0". In this initial state, at step 1201 an A/D conversion is performed upon the output $V_2$ of the downstream-side $O_2$ sensor 15, which is the output of the pull-up type input circuit 112. Then the control proceeds, via steps 1202 and 1203, to step 1204 which clears an activation counter CA. Then, at step 1205, it is determined whether or not the output $V_2$ of the pull-up type input circuit 112 is lower than the activation determination level A, and as a result, since $V_2<A$, the control proceeds to step 1215, thus completing this routine.

At the time $t_1$, when the output $V_2$ of the pull-up type input circuit 112 reaches the activation determination level A, the control at step 1205 proceeds to step 1206, which sets the provisional activation level $PF_{AC}$ ($PF_{AC}$="1").

Therefore, when the routine of FIG. 12 is again carried out, the control at step 1203 proceeds to step 1207, which counts up the activation counter CA by +1, and then via step 1208 to step 1215 to thus complete this routine. This state continues until a time $t_2$.

At the time $t_2$, when the activation counter CA reaches a predetermined value $CA_0$, the control at step 1208 proceeds to step 1209 to 1211. That is, when the base air-fuel ratio is rich and thus the output $V_2$ of the pull-up type input circuit 112 is located within the first region (A−B) as illustrated in FIG. 13A, the control proceeds, via step 1209, to step 1210 which sets the activation flag $F_{AC}$ ($F_{AC}$="1"). Also, when the base air-fuel ratio is lean and thus the output $V_2$ of the pull-up type input circuit 112 is located within the second region (C−), the control also proceeds, via step 1209, to step 1210 which sets the activation flag $F_{AC}$($F_{AC}$="1").

On the other hand, when the output $V_2$ of the pull-up type input circuit 112 is not located within the first and second regions, the control proceeds, via step 1211, to step 1212 which resets the provisional activation flag $PF_{AC}$, thus repeating the above-mentioned operation. That is, as illustrated in FIGS. 14A to 14D, the operation between the times $t_1$ and $t_2$ is repeated for times $t_3$ to $t_4$, $t_5$ to $t_6$, . . . , to set the activation flag $F_{AC}$.

After the activation flag $F_{AC}$ is set, the control at step 12O2 proceeds to steps 1213 and 1214. Therefore, even after the downstream-side $O_2$ sensor 15 is determined to be in an activation state, when the output $V_2$ of the pull-up type input circuit 112 becomes higher than a nonactivation determination level F, which is higher than the activation level A the activation flag $F_{AC}$ is reset ($F_{AC}$="0") by steps 1213 and 1214, and as a result, the downstream-side $O_2$ sensor 15 is determined to be in a nonactivation state.

Figure 24A:
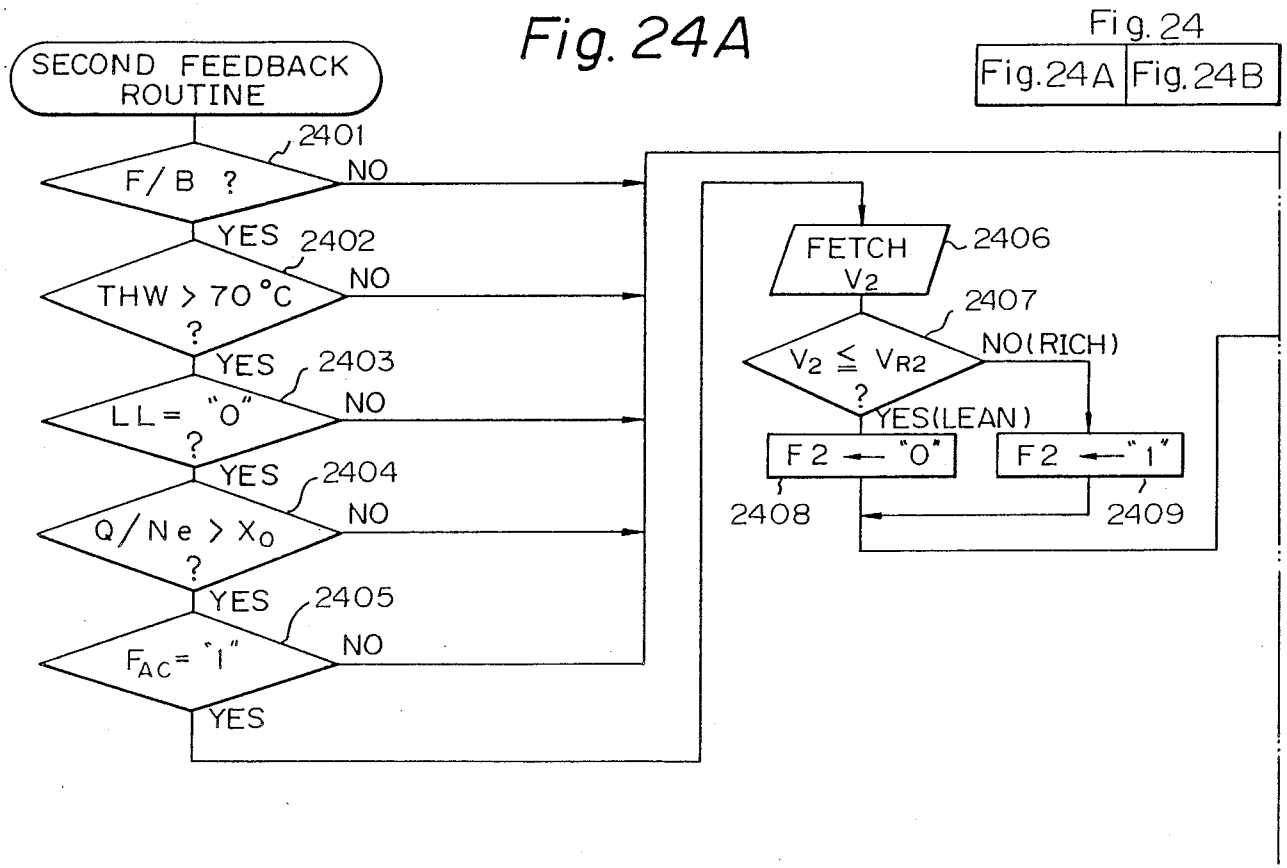
Figure 24B:
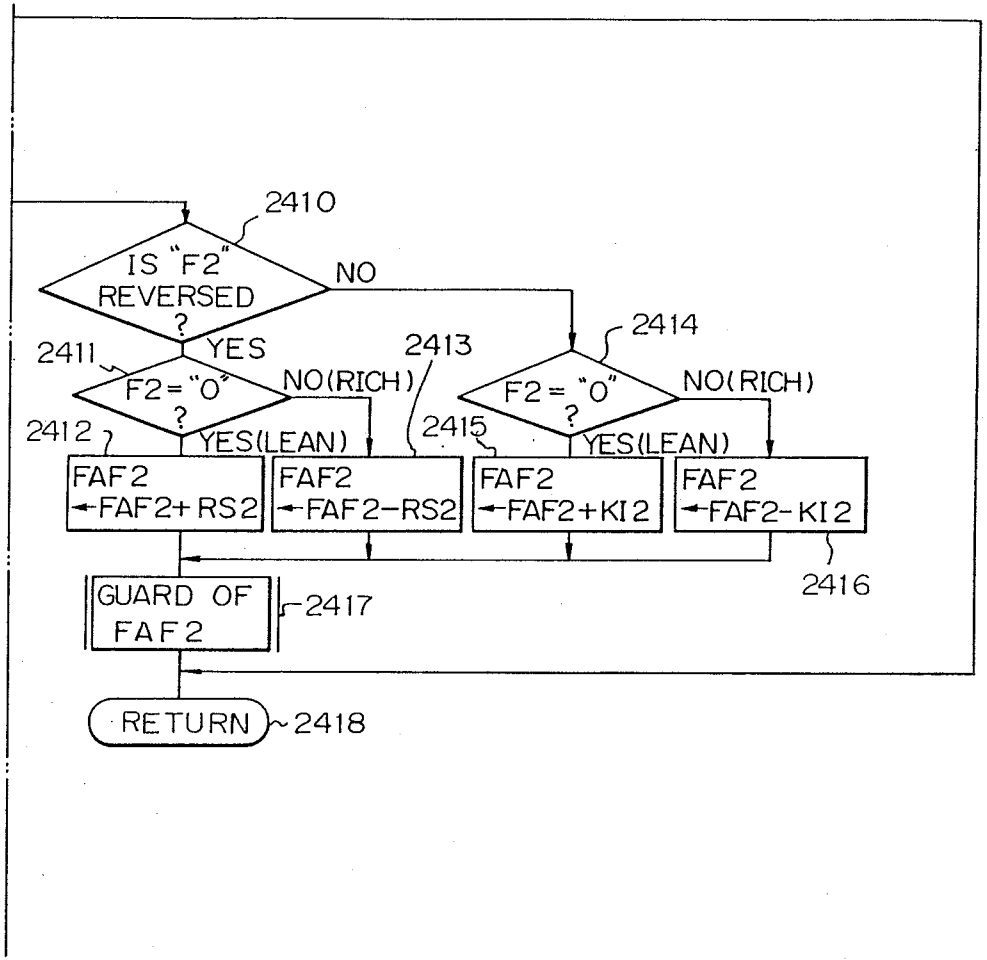

The above-mentioned activation flag $F_{AC}$ is used in a routine of FIG. 24.

Figure 15:
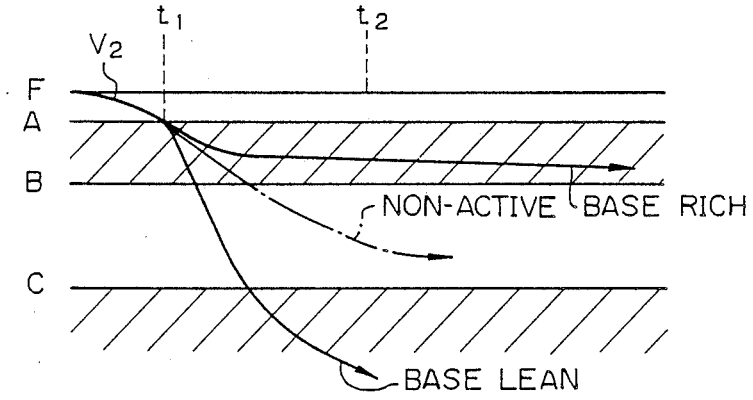
FIGS. 15 and 16 are timing diagrams explaining the principle of a second embodiment of the present invention.
Figure 16A:
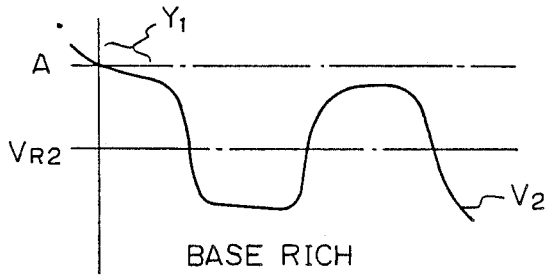
Figure 16B:
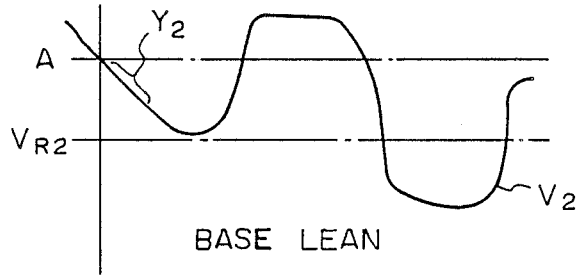

FIGS. 15 and 16 are timing diagrams showing the principle of a second embodiment of the present invention. In FIGS. 15 and 16, a determination of whether the base air-fuel ratio is rich or lean is carried out before the determination of the stated the output $V_2$ of the pull-up type input circuit 112. The principle of the second embodiment provides a greater enhancement of the reliability, compared with the principle of the first embodiment. The principle of the second embodiment is focussed on the variation of the output $V_2$ of the downstream-side $O_2$ sensor 15 immediately after the output $V_2$ of the pull-up type input circuit 112 becomes lower than the activation determination level A. That is, when the base air-fuel ratio is rich, the output $V_2$ of the pull-up type input circuit 112 is changed slowly as indicated by $Y_1$ in FIG. 15. On the other hand, when the base air-fuel ratio is lean, the output $V_2$ of the pull-up type input circuit 112 is changed rapidly, as indicated by $Y_2$ in FIG. 16. Therefore, the determination of whether the base air-fuel ratio is rich or lean can be carried out by using the variation of the output $V_2$ of the pull-up type input circuit 112.

Figure 17:
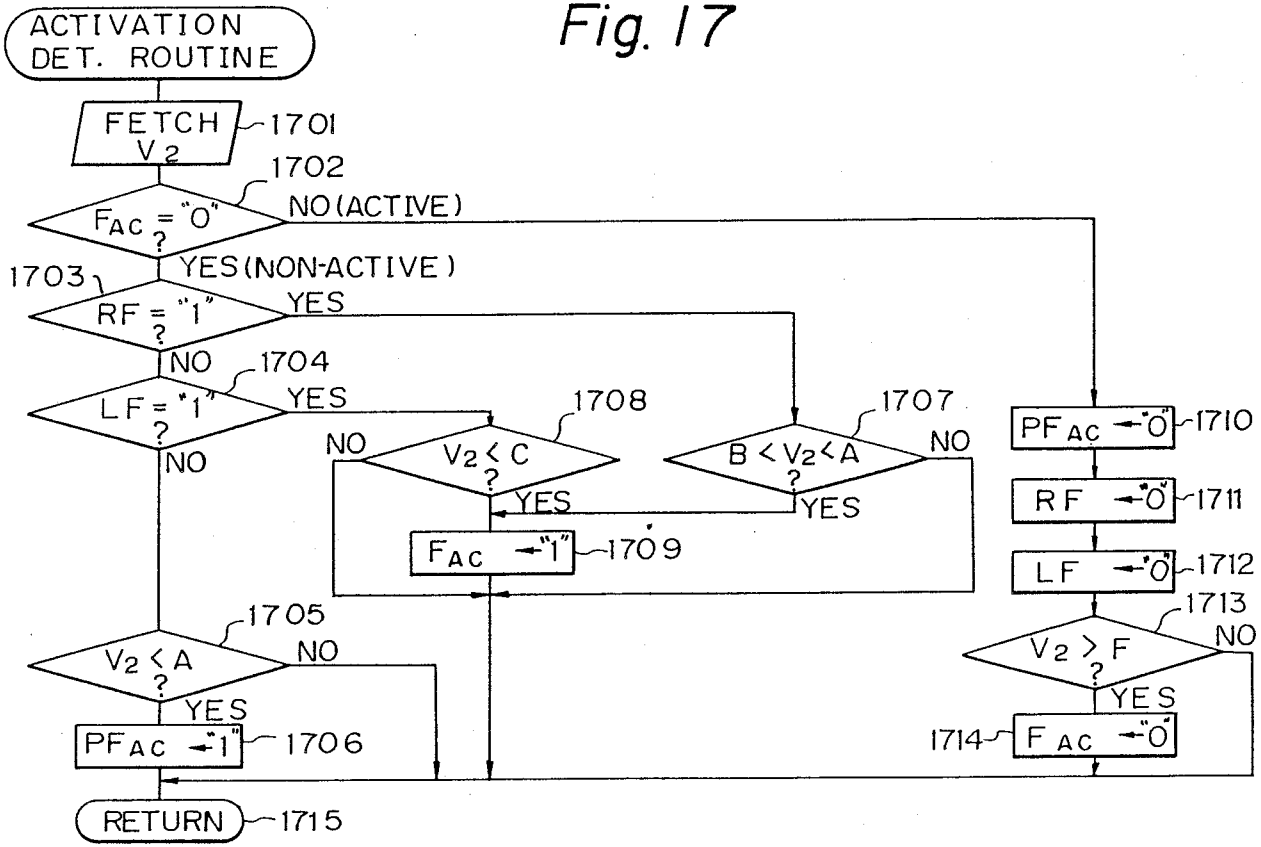

The principle of FIGS. 15 and 16 is realized by a routine of FIG. 17 which is carried out at a predetermined interval such as 512 ms. The routine of FIG. 17 will be explained with reference to FIGS. 19A to 19C. In an initial state before the time $t_1$, the downstream-side $O_2$ sensor 15 is not activated, and therefore, a provisional activation flag $PF_{AC}$, an activation flag $F_{AC}$, a rich base air-fuel ratio flag RF, and a lean base air-fuel ratio flag LF are all "0". In this initial state, at step 1701 an A/D conversion is performed upon the output $V_2$ of the downstream-side $O_2$ sensor 15, which is the output of the pull-up type input circuit 112. Then, the control proceeds, via steps 1702, 1703, and 1704 to step 1705 which clears an activation counter CA. Then, at step 1705, it is determined whether or not the output $V_2$ of the pull-up type input circuit 112 is lower than the activation determination level A, and as a result, since $V_2<A$, the control proceeds to step 1715, to thus complete this routine.

At the time $t_1$, when the output $V_2$ of the pull-up type input circuit 112 reaches the activation determination level A, the control at step 1705 proceeds to step 1706, which sets the provisional activation level $PF_{AC}$ ($PF_{AC}$="1").

After the provisional activation flag $PF_{AC}$ is set, a determination of the base air-fuel ratio is carried out at a time $t_3$ by a routine of FIG. 18, which will be explained later, and as a result, when the base air-fuel ratio is rich, the rich base air-fuel ratio flag RF is set by the routine of FIG. 18. Therefore, when the routine of FIG. 17 is again carried out, the control at step 1703 proceeds to step 1707, which determines whether or not the output $V_2$ of the pull-up type input circuit 112 is located within the first region ($B<V_2<A$). As a result, only when the output $V_2$ of the pull-up type input circuit 112 is located within the first region does the control proceed to step 1709, which sets the activation flag $F_{AC}$. On the other hand, when the base air-fuel ratio is lean, the lean base air-fuel ratio flag LF is set by the routine of FIG. 18. Therefore, when the routine of FIG. 17 is again carried out, the control at step 1704 proceeds to step 1708 which determines whether or not the output $V_2$ of the pull-up type input circuit 112 is located within the second region ($V_2<C$). As a result, only when the output $V_2$ of the pull-up type input circuit 112 is located within the second region does the control proceed to step 1709, which sets the activation flag $F_{AC}$.

Therefore, after the activation flag $F_{AC}$ is set, the control at step 1702 proceeds to steps 1710 to 1714. That is, at steps 1710, 1711 and 1712, the provisional activation flag $PF_{AC}$, the rich base air-fuel ratio PF, and the lean base air-fuel ratio flag LF are reset. Also, even after the downstream-side $O_2$ sensor 15 is determined to be in an activation state, when the output $V_2$ of the pull-up type input circuit 112 becomes higher than a nonactivation determination level F, which is higher than the activation level A, the activation flag $F_{AC}$ is reset ($F_{AC}$="0") by steps 1713 and 1714, and as a result, the downstream-side $O_2$ sensor 15 is determined to be in a nonactivation state.

Therefore, according to the routine of FIG. 17, after the base air-fuel ratio is determined to be rich or lean, a determination of the activation of the downstream-side $O_2$ sensor 15 continues until the output $V_2$ of the pull-up type input circuit 112 becomes within the first region ($B<V_2<A$) or the second region ($V_2<C$).

Note that step 1707 of FIG. 17 can be omitted, since a determination of whether or not the base air-fuel ratio is rich (RF="1") is carried out under the condition that the variation $\Delta V$ of the output $V_2$ of the pull-up type input circuit 112 is small, and therefore, in this case $B<V_2<A$ may be satisfied.

As explained above, when the base air-fuel ratio is rich, the output $V_2$ of the pull-up type input circuit 112 is relatively high in an activation state, and therefore, after the output $V_2$ of the pull-up type input circuit 112 becomes lower than the activation determination level A, the variation $\Delta V$ of the output $V_2$ is small. On the other hand, when the base air-fuel ratio is lean, the output $V_2$ of the pull-up type input circuit 112 is relatively low in an activation state, and therefore, after the output $V_2$ of the pull-up type input circuit 112 becomes lower than the activation determination level A, the variation $\Delta V$ of the output $V_2$ is large. Therefore, a determination of whether the base air-fuel ratio is rich or lean can be carried out by the variation $\Delta V$ of the output $V_2$ of the pull-up type input circuit 112.

Figure 18:
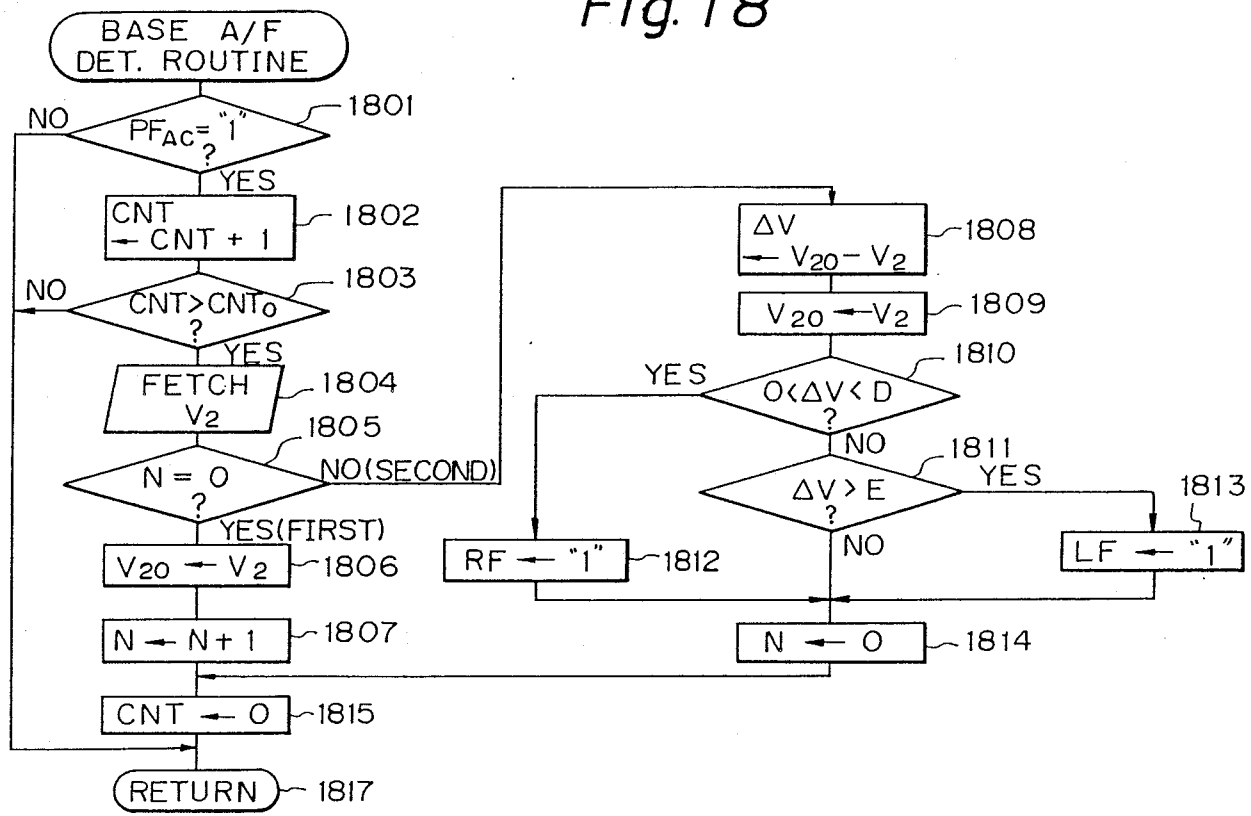
Figures 19A, 19B, 19C:
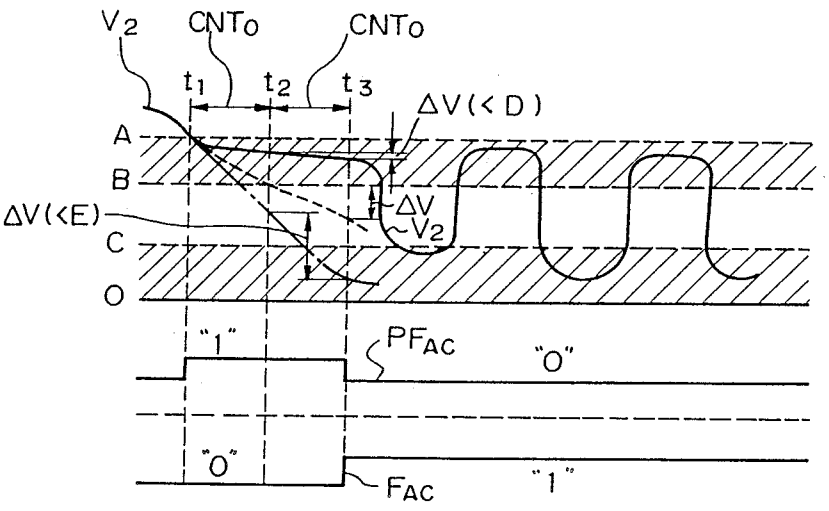
FIGS. 19A through 19C are timing diagrams explaining the flow chart of FIGS. 17 and 18.

FIG. 18 is a routine for determining whether the base air-fuel ratio is rich or lean after the output $V_2$ of the pull-up type input circuit 112 becomes lower than the activation determination level A, which is carried out at a predetermined interval such as 4 ms. In FIG. 18, the determination of the base air-fuel ratio is carried out by a variation $\Delta V$ of the output $V_2$ of the pull-up type input circuit 112 from a time $t_2$ to a time $t_3$ of FIGS. 19A to 19C. That is, at step 1801, it is determined whether or not the provisional activation flag $PF_{AC}$ set ($PF_{AC}$="1"). Therefore, only after the time $t_1$ of FIGS. 19A, 19B, and 19C is the control at steps 1802 to 1817 carried out.

At steps 1802 and 1803, a definite duration which is smaller than a reversion period of the downstream-side $O_2$ sensor 15 is measured. That is, at step 1802, the content of a counter CNT is counted up by +1, and at step 1803, it is determined whether or not $CNT > CNT_0$ is satisfied. As a result, at every definite duration ($CNT = CNT_0$), the control proceeds to steps 1804 to 1817. That is, in FIGS. 19A to 19C, the control at steps 1804 to 1817 is carried out at a first timing $t_2$, and at a second timing $t_3$.

Steps 1804 to 1817 will be explained below. AC step 1804, an A/D conversion is performed upon the output $V_2$ of the pull-up type input circuit 112, and if at the first timing (N=0), i.e., at the time $t_2$ of FIGS. 19A to 19C, the control proceeds via step 1805 to steps 1806 to 1808. At step 1806, a previous value $V_{20}$ is replaced by the current value $V_2$, and the value $V_{20}$ ($=V_2$) is stored in the RAM 106. AC step 1807, the content of a counter N is counted up by +1 (N=1). Then, at step 1815, the counter CNT is cleared, to thus restart the counter CNT, and the control proceeds to step 1817.

The routine of FIG. 18 is continuously carried out. Then, at a time $t_3$, the control proceeds via step 1805 to steps 1808 to 1814, since N=1. AC step 1808, the previous value $N_{20}$ is read out of the RAM 106, and the variation $\Delta V$ of the output $V_2$ of the pull-up type input circuit 112 is calculated by $$\Delta V \leftarrow V_{20} - V_2.$$

Then, at step 1809, $V_{20}$ is replaced by the current value $V_0$ and is again stored in the RAM 106.

At step 1810, it is determined whether or not the deviation $\Delta V$ is small, i.e., the base air-fuel ratio is rich. That is, as shown in FIGS. 19A to 19C, when the base air-fuel ratio is rich, the deviation $\Delta V$ from time $t_2$ to time $t_3$ is small enough to satisfy the condition that $0 < \Delta V < D$ (definite value). In this case, the control proceeds to step 1812, which sets the rich base air-fuel ratio flag RF.

At step 1811, it is determined whether or not the variation $\Delta V$ is large, i.e., the base air-fuel ratio is lean. That is, as shown in FIGS. 19A to 19C, when the base air-fuel ratio is rich, the variation $\Delta V$ from time $t_2$ to time $t_3$ is large enough to satisfy the condition that $\Delta V > E$ (definite value). In this case, the control proceeds to step 1813 which sets the lean base air-fuel ratio flag LF. Otherwise, i.e., if $D \leqq \Delta V \leqq E$, the control proceeds directly to step 1814 which clears the counter N.

Then, at step 1815, the counter CNT is cleared, and thus this routine is completed.

Figures 20, 20A:
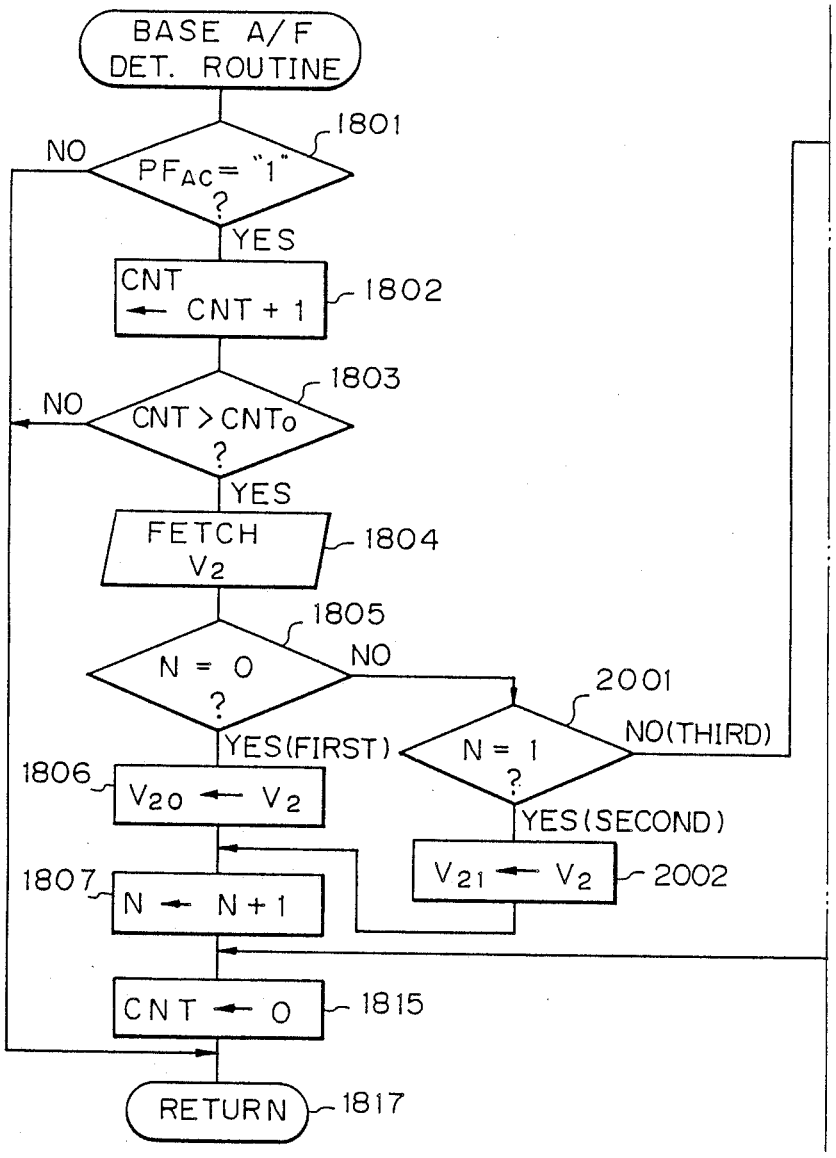
Figure 20B:
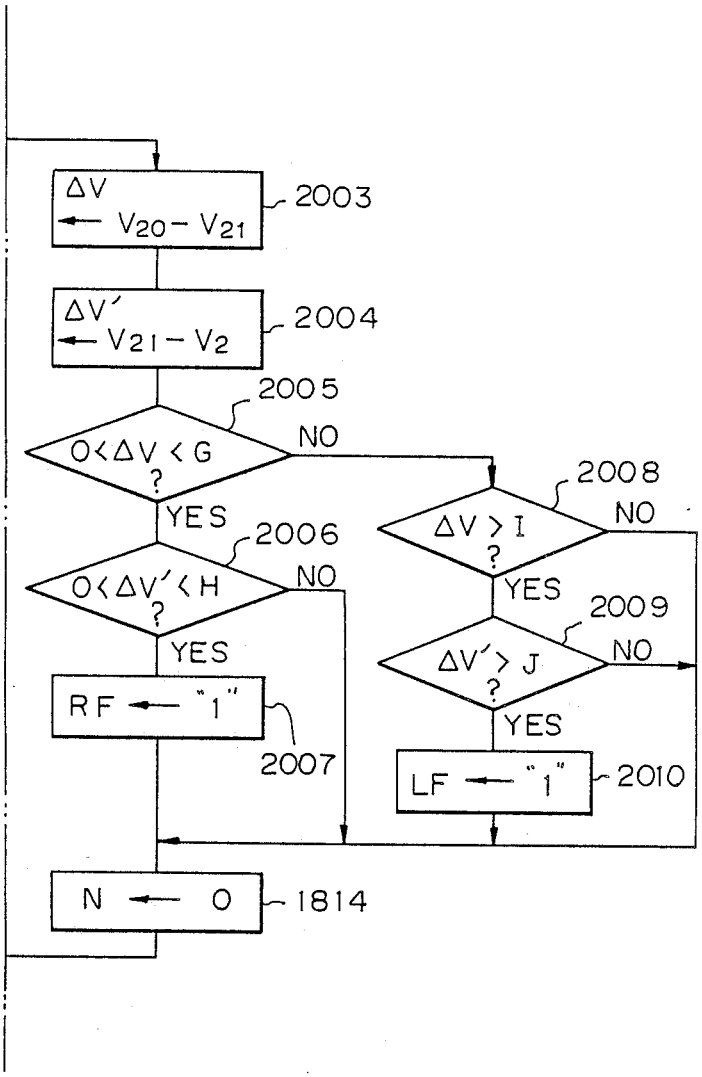
Figures 21A, 21B, 21C:
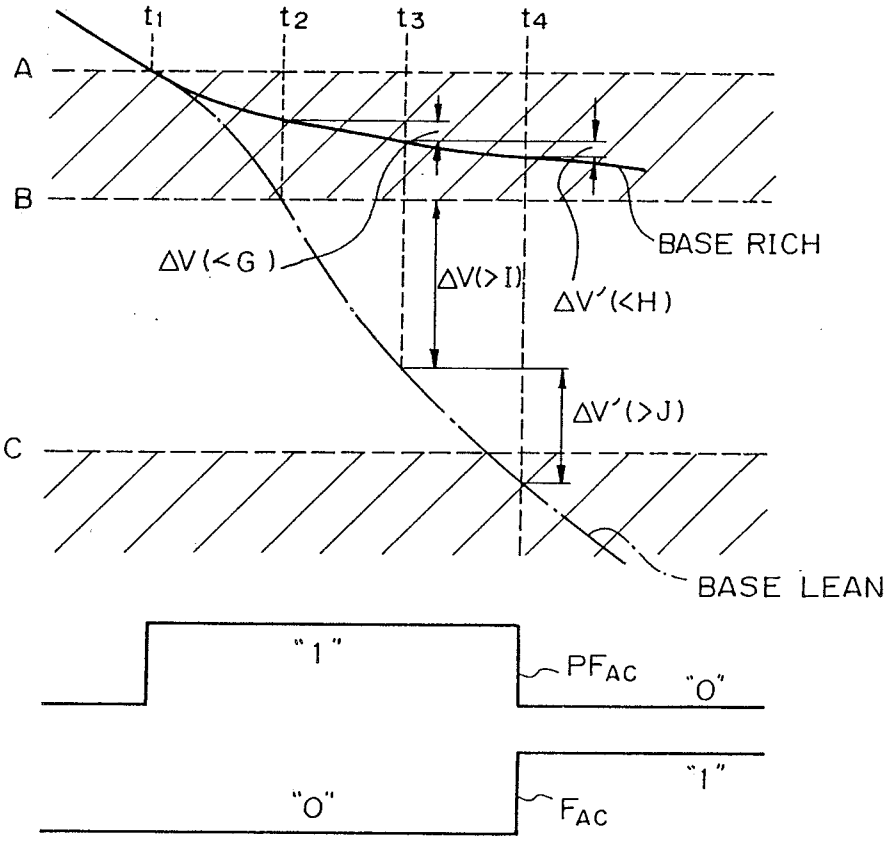
FIGS. 21A through 21C are timing diagrams explaining the flow chart of FIG. 20.

In FIG. 20, which is a modification of FIG. 18, two variations $\Delta V$ and $\Delta V'$ from the time $t_2$ to the time $t_3$ and from the time $t_3$ to the time $t_4$, respectively of FIGS. 21A to 21C are calculated, to determine whether the base air-fuel ratio is rich or lean. For this purpose, steps 2001 to 2010 are provided instead of steps 1808 to 1813 of FIG. 18. Note that the value $CNT_0$ of FIG. 20 is smaller than that of FIG. 18.

As in FIG. 18, at step 1801, it is determined whether or not the provisional activation flag $PF_{AC}$ is set ($PF_{AC}$="1"). Therefore, only after time $t_1$ of FIGS. 21A, 21B, and 21C is the control at step 1802 and preceding steps carried out.

At steps 1802 and 1803, a definite duration, which is smaller than a reversion period of the downstream-side $O_2$ sensor 15, is measured. That is, at step 1802, the content of a counter CNT is counted up by +1, and, at step 1803, it is determined whether or not $CNT > CNT_0$ is satisfied. As a result, at every definite duration ($CNT = CNT_0$), the control proceeds to step 1804 and the preceding steps. That is, in FIGS. 21A to 21C, the control at steps 1804 and the following steps is carried out at a first timing $t_2$, at a second timing $t_3$, and at a third timing $t_4$. Step 1804 and its post steps will be explained below. At step 1804, an A/D conversion is performed upon the output $V_2$ of the pull-up type input circuit 112, and if at the first timing (N=0), i.e., at time $t_2$ of FIGS. 21A to 21C, the control proceeds, via step 1805, to steps 1806 to 1807. At step 1806, a previous value is replaced by the current value $V_2$, and the value $V_{20}$ ($=V_2$) is stored in the RAM 106. At step 1807, the content of a counter N is counted up by +1 (N=1). Then, at step 1815, the counter CNT is cleared, to thus restart the counter CNT, and the control proceeds to step 1817.

The routine of FIG. 20 is continuously carried out. Then, at the time $t_3$, the control proceeds, via steps 1805 and 2001 to steps 2002 to 1807, since N=1. At step 2002, $V_{21}$ is replaced by the current value $V_0$ and is again stored in the RAM 106. Further, at step 1807, the content of the counter N is counted up by +1 (N=2). Then, at step 1815 and the counter CNT is cleaved again, to thus restart the counter CNT, and the control proceeds to step 1817.

The routine of FIG. 20 is continuously carried out. Then, at the time $t_4$, the control proceeds via steps 1805 and 2001 to steps 2003 to 2010 and step 1814, since N=2. at step 2003, the previous value $N_{20}$ and the immediately previous value $N_{21}$ are read out of the RAM 106, and the variation $\Delta V$ of the output $V_2$ of the pull-up type input circuit 112 is calculated by $$\Delta V \leftarrow V_{20} - V_{21}.$$

Then, at step 2004, the variation $\Delta V'$ of the output $V_2$ of the pull-up type input circuit 112 is calculated by $$\Delta V \leftarrow V_{21} - V_2.$$

At steps 2005 and 2006, it is determined whether or not the variation $\Delta V$ and $\Delta V'$ are small, i.e., the base air-fuel ratio is rich. That is, as shown in FIGS. 21A to 21C, when the base air-fuel ratio is rich, the variation $\Delta V$ from the time $t_2$ to the time $t_3$ is small enough to satisfy the condition that $0 < \Delta V < G$ (definite value), and also the variation $\Delta V$ from the time $t_3$, to the time $t_4$ is small enough satisfy the condition that $0 < \Delta V' < H$ (definite value). In this case, the control proceeds to step 2007 which sets the rich base air-fuel ratio flag RF. On the other hand, at steps 2008 and 2009, it is determined whether or not the variations $\Delta V$ and $\Delta V$, are large, i.e., the base air-fuel ratio is lean. That is, as shown in FIGS. 21A to 21C, when the base air-fuel ratio is lean, the variation $\Delta V$ from the time $t_2$ to the time $t_3$ is large enough to satisfy the condition that $\Delta V > I$ (definite value), and also, the variation $\Delta V$ from the time $t_3$ to the time $t_4$ is large enough to satisfy the condition that $\Delta V' > J$ (definite value). In this case, the control proceeds to step 2010 which sets the lean base air-fuel ratio flag LF. Otherwise, the control proceeds directly to step 1814, which clears the counter N.

Then, at step 1815, the counter CNT is cleared, and thus this routine is completed.

Note that the determination of whether the base air-fuel ratio is rich or lean can be carried out by using three or more variations of the output $V_2$ of the pull-up type input circuit 112.

Figure 22:
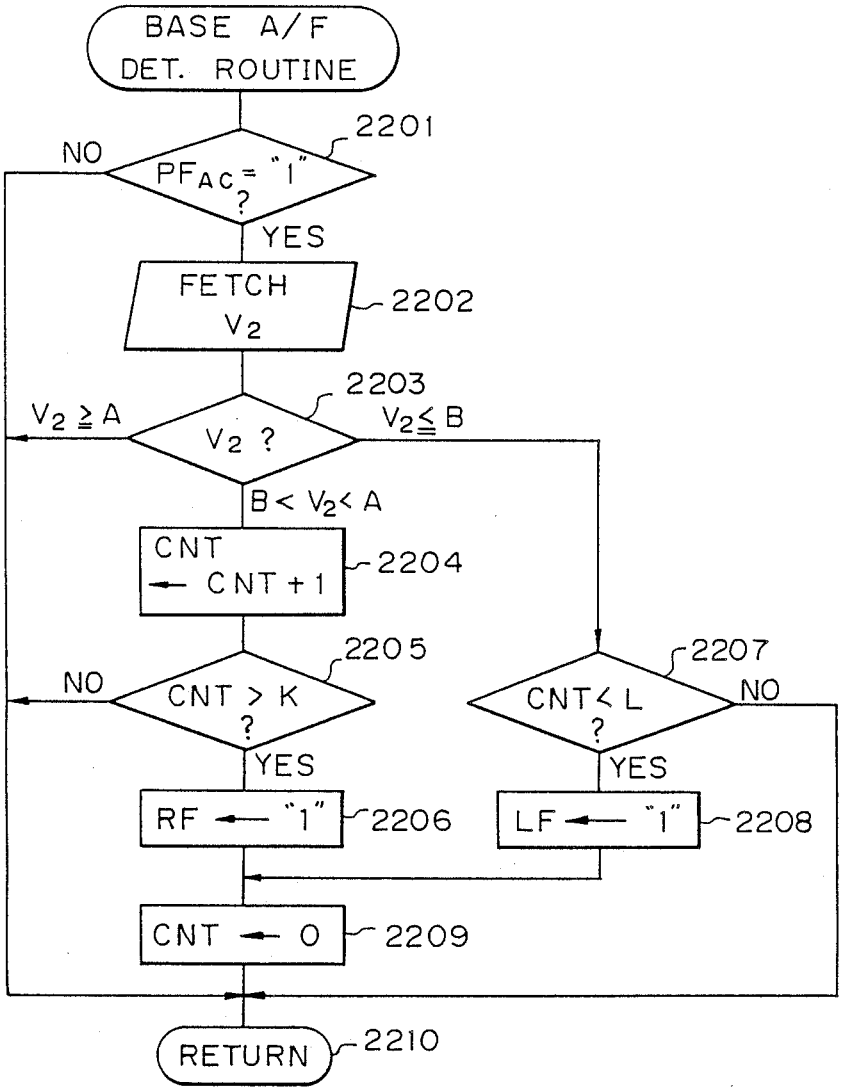
Figures 23A, 23B, 23C, 23D:
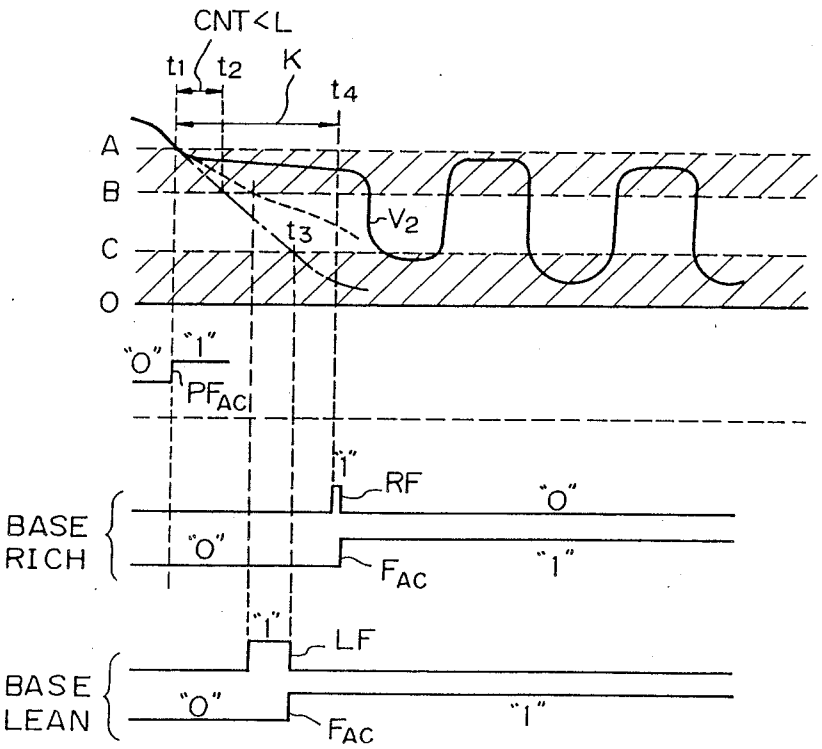
FIGS. 23A through 23D are timing diagrams explaining the flow chart of FIG. 22.

In FIG. 22, which is another modification of FIG. 18, after the output $V_2$ of the pull-up type input circuit 112 becomes lower than the activation determination level A, when the output $V_2$ of the pull-up type input circuit 112 is located within the first region ($B < V_2 < A$) for a predetermined time (CNT=K), the variation $\Delta V$ of the output $V_2$ of the pull-up type input circuit 112 is determined to be small enough that the base air-fuel ratio is rich and the downstream-side $O_2$ sensor 15 is active. On the other hand, when a time from the timing at which the output $V_2$ of the pull-up type input circuit 112 becomes lower than the activation determination level A to a timing at which the output $V_2$ of the pull-up type input circuit 112 becomes lower than the minimum level B of the first region, is small (CNT <L) the variation $\Delta V$ of the output $V_2$ of the pull-up type input circuit 112 is determined to be large enough that the base air-fuel ratio is lean and the downstream-side $O_2$ sensor 15 is active.

That is, at step 2201, it is determined whether or not the provisional activation flag $PF_{AC}$ is set ($PF_{AC}$="1"). Therefore, only after time $t_1$ of FIGS. 23A to 23D is the control at steps 2202 to 2206 carried out.

At steps 2302, an A/D conversion is performed upon the output $V_2$ of the pull-up type input circuit 112, and at step 2303, it is determined whether or not the output $v_2$ of the pull-up type input circuit 112 is located within the first region ($B < V_2 < A$).

For example, if the base air-fuel ratio is rich so as to satisfy $B < V_2 < A$, the control at step 2303 proceeds to step 2304 which counts up the counter CNT, and then the control proceeds via step 2305 to step 2310. This state continues until CNT>K is satisfied, i.e., until the time $t_4$ of FIGS. 23A to 23D. As a result, when CNT>K, the control at step 2305 proceeds to step 2306, which sets the rich base air-fuel ratio flag RF, and then the control proceeds to step 2310, which clears the counter CNT. As a result, the activation flag $F_{AC}$ is set by the routine of FIG. 17.

On the other hand, even if the base air-fuel ratio is lean, but if $B < V_2 < A$, is satisfied, the control at step 2303 proceeds to step 2304 which counts up the counter CNT, and then the control proceeds via step 2305 to step 2310. In this case, however, the output $V_2$ of the pull-up type input circuit 112 rapidly reaches the level B, i.e., at the time $t_2$ of FIGS. 23A to 23D, and as a result, the flow from step 2303 the flow from step 2303 to step 2204 is switched to the flow from step 2203 to 2207. Accordingly, when CNT<L is satisfied at step 2207, the control proceeds to step 2208, which sets the lean base air-fuel ratio flag LF, and then the control proceeds to step 2310, which clears the counter CNT. As a result, at the time $t_3$ at which $V_2 < C$ is satisfied, the activation flag $F_{AC}$ is set by steps 1708 and 1709 of the routine of FIG. 17.

A double $O_2$ sensor system into which a second air-fuel ratio correction amount FAF2 is introduced will be explained with reference to FIGS. 24 and 25.

FIG. 24 is a routine for calculating a second air-fuel ratio feedback correction amount FAF2 in accordance with the output of the downstream-side $O_2$ sensor 15 executed at every predetermined time period such as 1 s.

At steps 2401 through 2405, it is determined whether or not all of the feedback control (closed-loop control) conditions by the downstream-side $O_2$ sensor 15 are satisfied. For example, at step 2401, it is determined whether or not the feedback control conditions by the upstream-side $O_2$ sensor 13 are satisfied. At step 2402, it is determined whether or not the coolant temperature THW is higher than 70° C. At step 2403, it is determined whether or not the throttle valve 16 is open (LL="0"). At step 2404, it is determined whether or not a load parameter such as Q/Ne is larger than a predetermined value $X_0$. At step 2405, it is determined whether or not the downstream-side $O_2$ sensor 15 is active by determining whether the activation flag $F_{AC}$ is "1" or "0". Of course, other feedback control conditions are introduced as occasion demands. For example, a condition of whether or not the secondary air suction system is driven when the engine is in a deceleration state, but an explanation of such other feedback control conditions is omitted.

If one or more of the feedback control conditions is not satisfied, the control directly proceeds to step 2418, thereby carrying out an open-loop control operation. Note that, in this case, the amount FAF2 or a mean value $\overline{FAF2}$ thereof is stored in the backup RAM 106, and in an open-loop control operation, the value FAF2 or $\overline{FAF2}$ is read out of the backup RAM 106.

Contrary to the above, if all of the feedback control conditions are satisfied, the control proceeds to step 2406.

At step 2406, an A/D conversion is performed upon the output voltage $V_2$ of the downstream-side $O_2$ sensor 15, i.e., the output of the pull-up type input circuit 112, and the A/D converted value thereof is fetched from the A/D converter 101. At step 2407, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 ) is preferably higher than the reference voltage (=0.45 V), in consideration of the different in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 2407, if the air-fuel ratio downstream of the catalyst converter 12 is lean, the control proceeds to step 2408 which resets a second air-fuel ratio flag F2. Alternatively, the control proceeds to the step 2409, which sets the second air-fuel ratio flag F2.

Next, at step 2410, it is determined whether or not the second air-fuel ratio flag F2 is reversed. If the second air-fuel ratio flag F2 is reversed, the control proceeds to steps 2411 to 2413 which carry out a skip operation. That is, if the flag F2 is "0" (lean) at step 2411, the control proceeds to step 2412, which remarkably increases the second correction amount FAF2 by a skip amount RS2. Also, if the flag F2 is "1" (rich) at step 2411, the control proceeds to step 2413, which remarkably decreases the second correction amount FAF2 by the skip amount RS2. On the other hand, if the second air-fuel ratio flag F2 is not reversed at step 2410, the control proceeds to steps 2414 to 2416, which carry out an integration operation. That is, if the flag F2 is "0" (lean) at step 2414, the control proceeds to step 2415, which gradually increases the second correction amount FAF2 by an integration amount KI2. Also, if the flag F2 is "1" (rich) at step 2414, the control proceeds to step 2416, which gradually decreases the second correction amount FAF2 by the integration amount KI2.

Note that the skip amount RS2 is larger than the integration amount KI2.

At step 2417, the second correction amount FAF2 is guarded by a minimum value 0.8, and by a maximum value 1.2, thereby also preventing the controlled air-fuel ratio from becoming overrich or overlean.

The routine of FIG. 24 is then completed by step 2418.

Figure 25:
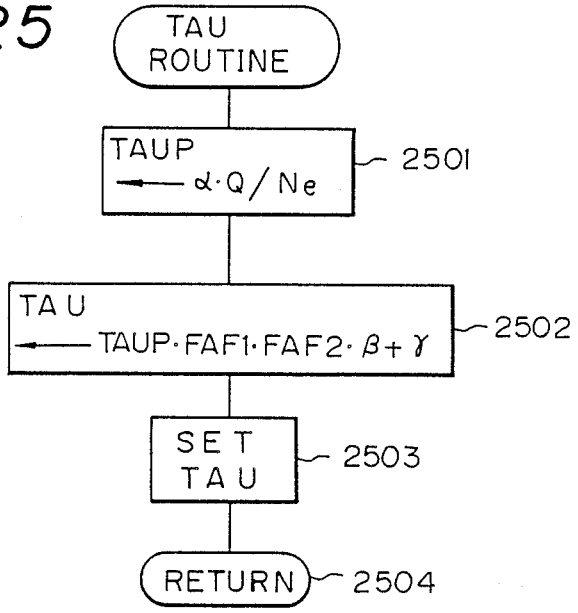

FIG. 25 is a routine for calculating a fuel injection amount TAU executed at every predetermined crank angle such as 360° CA. At step 2501, a base fuel injection amount TAUP is calculated by using the intake air amount data Q and the engine speed data Ne stored in the RAM 105. That is $$TAUP \leftarrow \alpha \cdot Q/Ne$$

where $\alpha$ is a constant. At step 2502, a final fuel injection amount TAU is calculated by $$TAU \leftarrow TAUP \cdot FAF1 \cdot FAF2 \cdot \beta + \gamma$$

where $\beta$ and $\gamma$ are correction factors determined by other parameters such as the voltage of the battery and the temperature of the intake air. At step 2503, the final fuel injection amount TAU is set in the down counter 107, and in addition, the flip-flop 108 is set to initiate the activation of the fuel injection valve 7. Then, this routine is completed by step 2504. Note that, as explained above, when a time corresponding to the amount TAU has passed, the flip-flop 109 is reset by the borrow-out signal of the down counter 108 to stop the activation of the fuel injection valve 7.

A double $O_2$ sensor system, in which an air-fuel ratio feedback control parameter of the first air-fuel ratio feedback control by the upstream-side $O_2$ sensor is variable, will be explained with reference to FIGS. 26 and 27. In this case, the skip amounts RSR and RSL as the air-fuel ratio feedback control parameters are variable.

Figures 26, 26A:
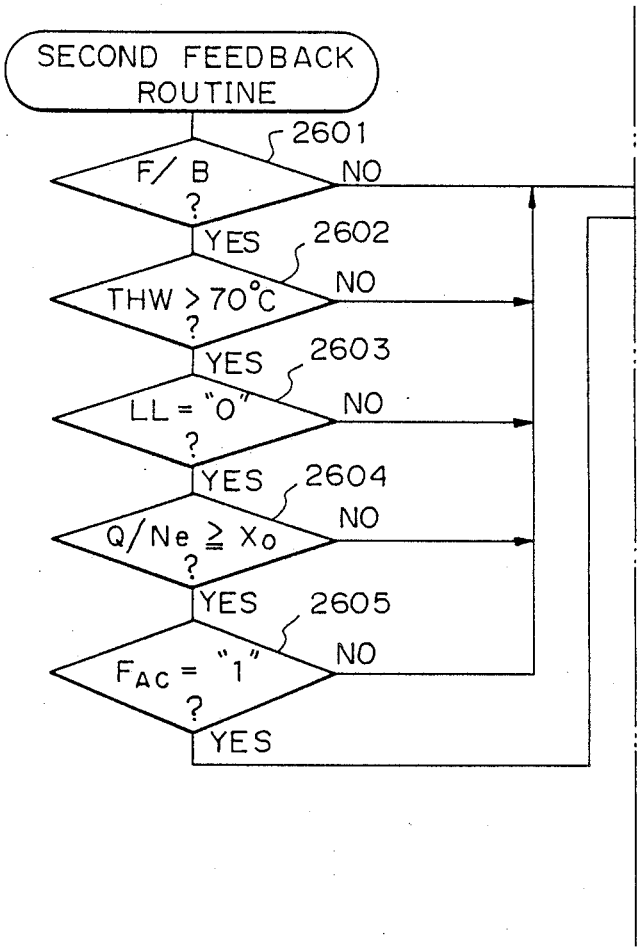
Figure 26B:
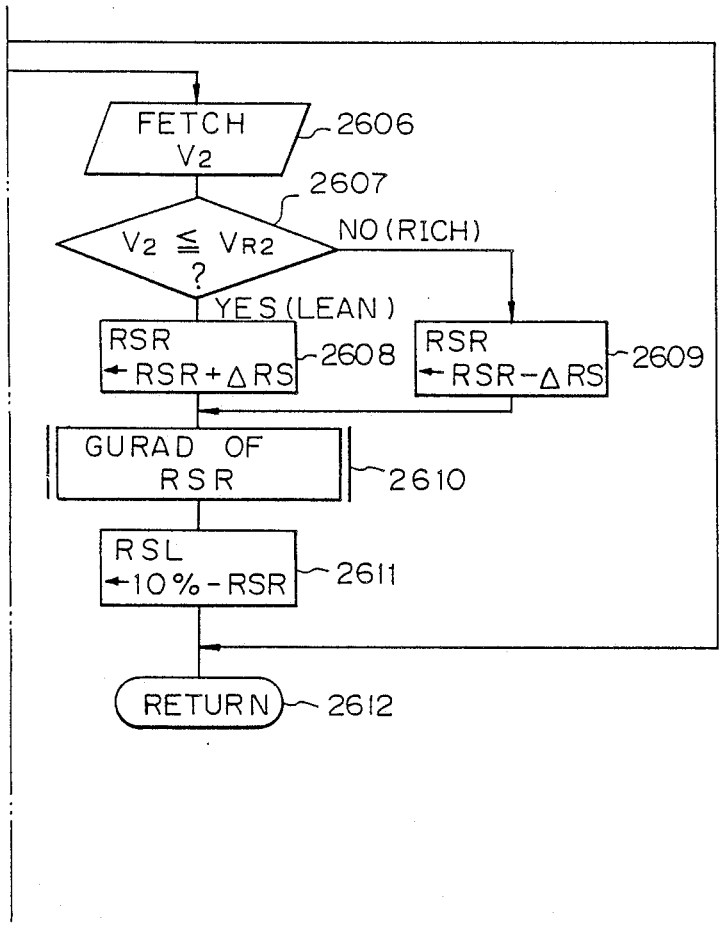

FIG. 26 is a routine for calculating the skip amounts RSR and RSL in accordance with the output $V_2$ of the downstream-side $O_2$ sensor 15 executed at every predetermined time period such as 1 s.

Steps 2601 through 2605 are the same as steps 2401 through 2405 of FIG. 24. That is, if one or more of the feedback control conditions is not satisfied, the control proceeds directly to step 2611, thereby carrying out an open-loop control operation. Note that, in this case, the skip amount RSR (RSL) or a mean value $\overline{RSR}$ ($\overline{RSL}$) thereof is stored in the backup RAM 106, and in an open-loop control operation, the value RSR (RSL) or $\overline{RSR}$ ($\overline{RSL}$) is read out of the backup RAM 106.

Contrary to the above, if all of the feedback control conditions are satisfied, the control proceeds to steps 2606 through 2611.

At step 2606, an A/D conversion is performed upon the output voltage $V_2$ of the downstream-side $O_2$ sensor 15, i.e., the output of the pull-up type input circuit 112, and the A/D converted value thereof is fetched from the A/D converter 101. At step 2607, the voltage $V_2$ is compared with a reference volta $V_{R2}$, thereby determining whether the current air-fuel ratio detected by the downstream-side $O_2$ sensor 15 is on the rich side or on the lean side with respect to the stoichiometric air-fuel ratio. As a result, at step 2607, if the air-fuel ratio downstream of the catalyst converter 12 is lean, the control proceeds to step 2608. Alternatively, the control proceeds to the step 2609.

At step 2608, the rich skip amount RSR is increased by ΔRS to move the air-fuel ratio to the rich side. On the other hand, at step 2609, the rich skip amount RSR is decreased by ΔRS to move the air-fuel ratio to the lean side. At step 2610, the rich skip amount RSR is guarded by a maximum value MAX such as 7.5% and a minimum value MIN such as 2.5%. Note that the minimum value MIN is a level by which the transient characteristics of the skip operation using the amounts RSR and RSL can be maintained, and the maximum value MAX is a level by which the drivability is not deteriorated by the fluctuation of the air-fuel ratio.

Then, at step 2611, the lean skip amount RSL is calculated by $$RSL \leftarrow 10\% - RSR.$$

The routine of FIG. 26 is then completed by step 2611.

Figure 27:
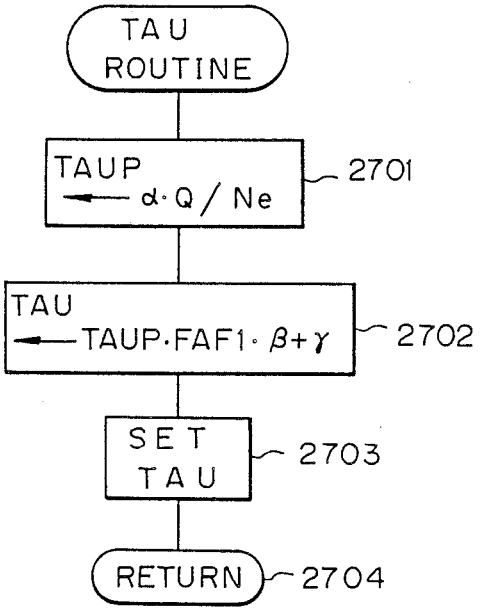

FIG. 27 is a routine for calculating a fuel injection amount TAU executed at every predetermined crank angle such as 360° CA. At step 2701, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 2702, a final fuel injection amount TAU is calculated by $$TAU \leftarrow TAUP \cdot FAF1 \cdot \beta + \gamma$$

where $\beta$ and $\gamma$ are correction factors determined by other parameters such as the voltage of the battery and the temperature of the intake air. At step 2703, the final fuel injection amount TAU is set in the down counter 107, and in addition, the flip-flop 108 is set to initiate the activation of the fuel injection valve 7. Then, this routine is completed by step 2704. Note that, as explained above, when a time period corresponding to the amount TAU has passed, the flip-flop 109 is reset by the borrow-out signal of the down counter 108 to stop the activation of the fuel injection.

Thus, after the output $V_2$ of the pull-up type input circuit 112 becomes lower than the activation determination level A, a determination of the activation of the downstream-side $O_2$ sensor 15 is carried out by determining whether or not the output $V_2$ of the pull-up type input circuit 112 is within the predetermined regions ($B < V_2 < A$, $V_2 < C$). Also, a determination of whether the base air-fuel ratio immediately after the determination for the activation determination level A is rich or lean is provided, to enhance the reliability of the determination of activation of the downstream-side $O_2$ sensor 15, and therefore, overcorrection of the second air-fuel ratio correction amount FAF2 or the air-fuel ratio feedback control parameter can be avoided.

Figure 28:
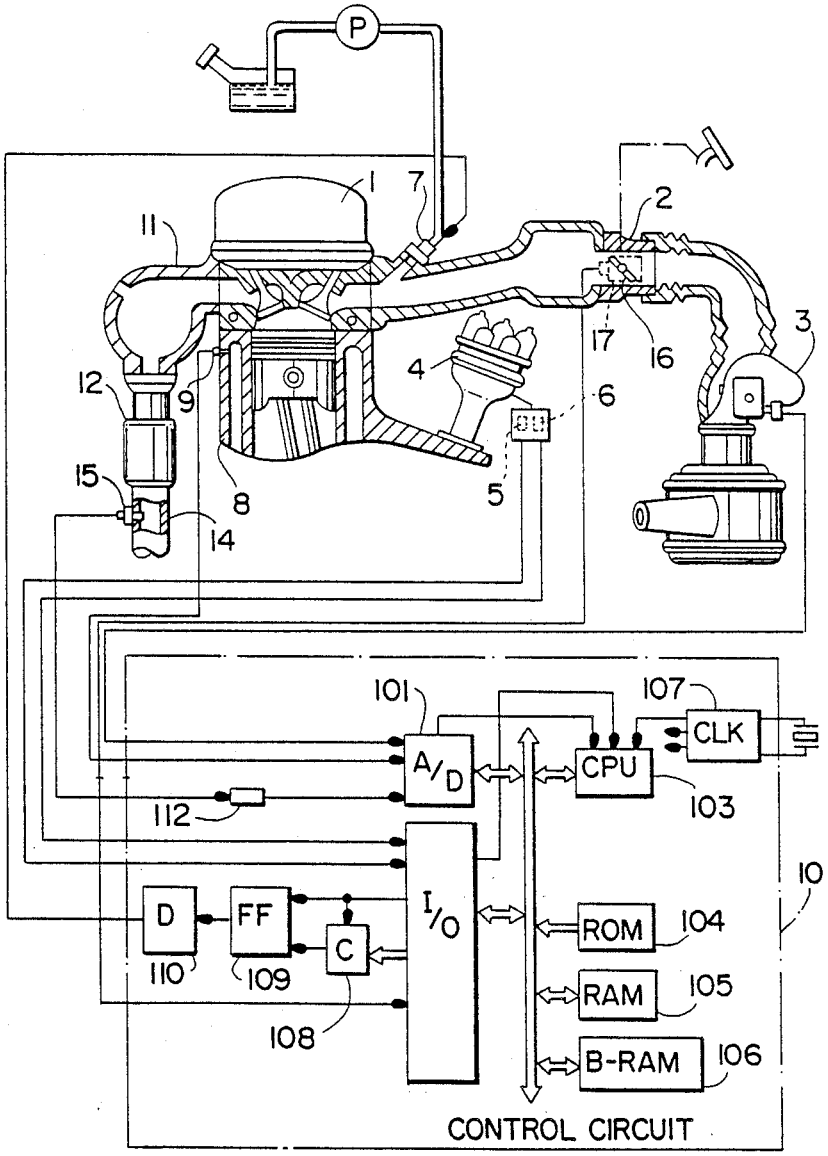
FIGS. 28, 29 and 30 are schematic views similar to FIG. 8 but illustrating other embodiments wherein a single oxygen sensor is located downstream of the catalyst converter (FIG. 28), within the catalyst converter (FIG. 29), or upstream of the catalyst converter (FIG. 30).
Figure 29:
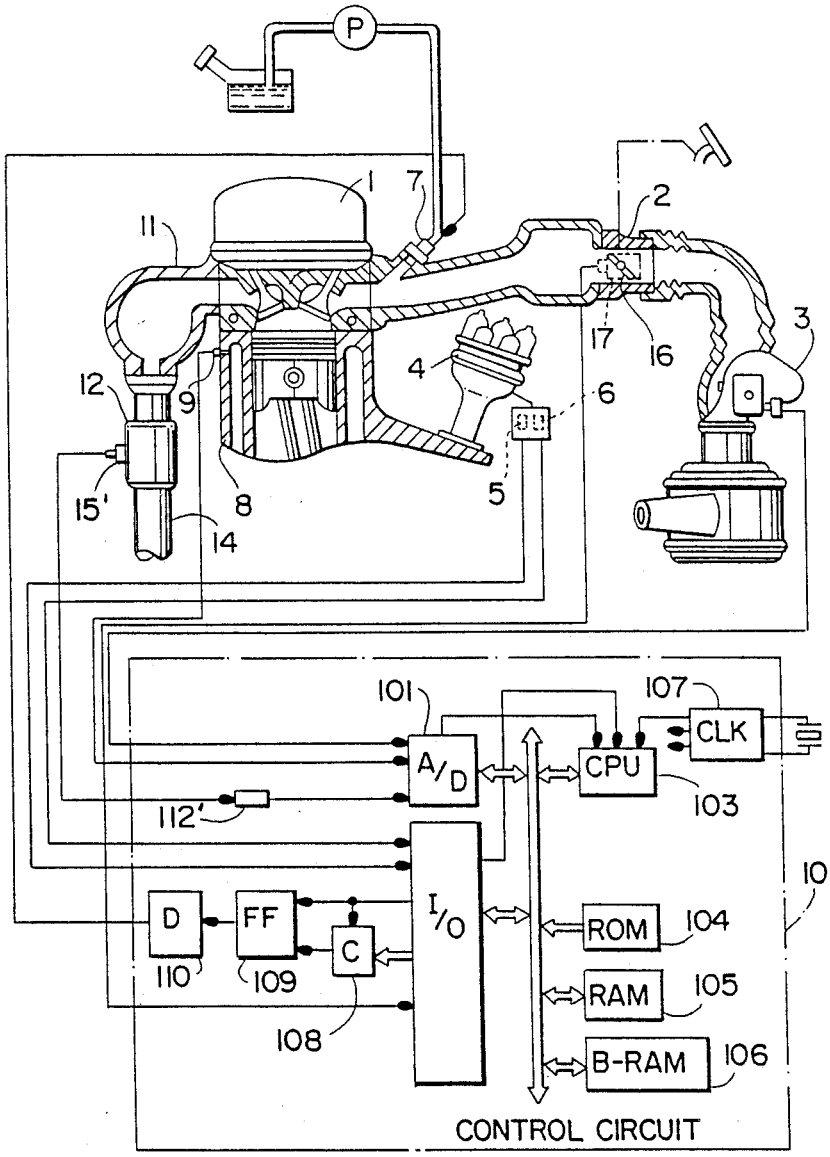
Figure 30:
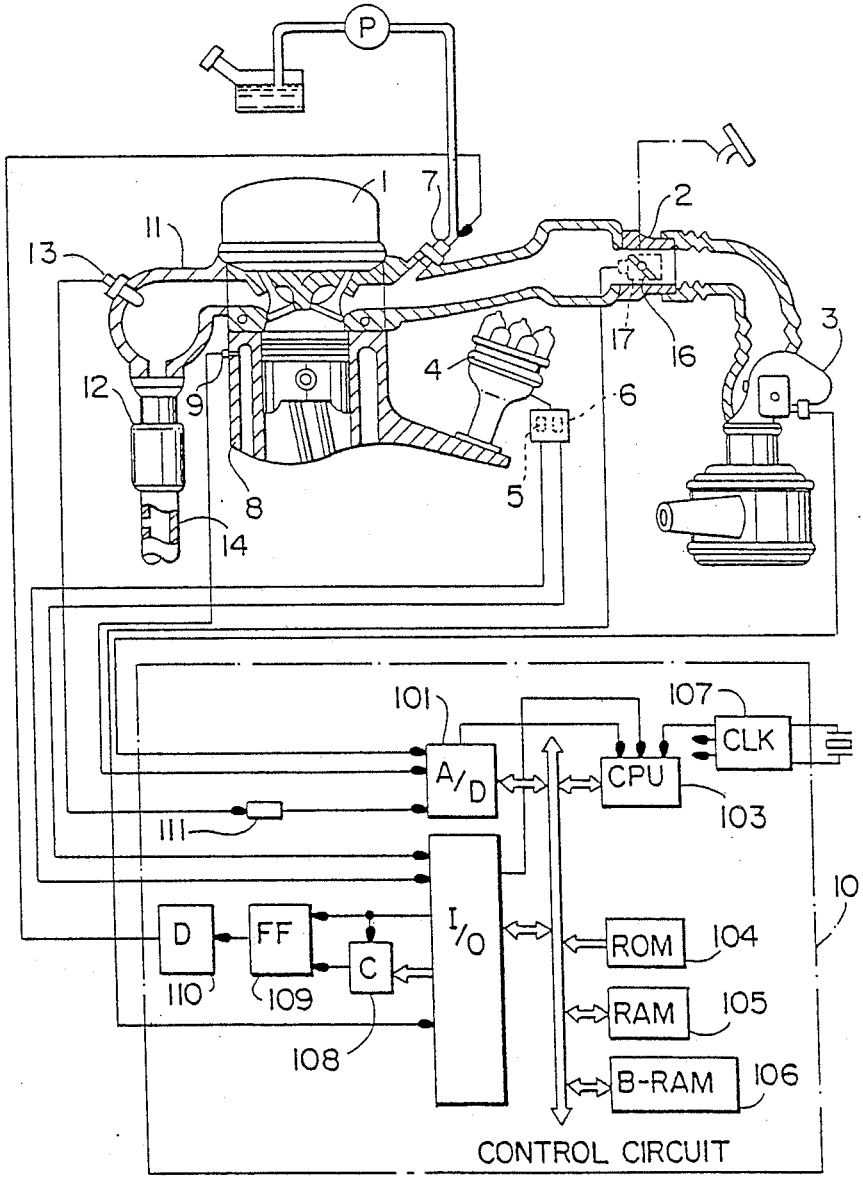

The present invention is also applied to a single $O_2$ sensor system where only one $O_2$ sensor 15 is provided downstream of or within the catalyst converter 12. FIG. 28 illustrates an oxygen sensor 15 downstream of the catalyst converter 12, FIG. 29 illustrates an oxygen sensor 15' within the catalyst converter 12 and FIG. 30 illustrate an oxygen sensor 13 upstream of the catalyst converter 12. In this case, the routines of FIGS. 12, 26, and 27 are not used, while the routines of FIGS. 24 and 25 are used. Also, at step 2502 of FIG. 25, the time period TAU is calculated by $$TAU \leftarrow TAUP \cdot FAF2 \cdot (FWL + \beta) + \gamma.$$

Note that the first air-fuel ratio feedback control by the upstream-side $O_2$ sensor 13 is carried out at a predetermined relatively short interval, such as 4 ms, and the second air-fuel ratio feedback control by the downstream-side $O_2$ sensor 15 is carried out at a predetermined relatively long interval, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay times TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine is which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 2401 of FIG. 24 or at step 2701 or FIG. 27 is determined by the carburetor itself, i.e., the intake air negative pressure and the engine speed, and the air amount corresponding to TAU is calculated at step 2402 of FIG. 24 or at step 2702 of FIG. 27.

Further, a CO sensor, a lean-mixture sensor or the like can be also used instead of the $O_2$ sensor.

As explained above, according to the present invention, since the determination of activation and non-activation of an air-fuel ratio sensor downstream of or within a catalyst converter is reliably carried out, the hunting of the determination of activation and non-activation of the air-fuel ratio sensor is reduced, thus avoiding an overcorrection of the air-fuel ratio control amount such as the second air-fuel ratio correction amount and the air-fuel ratio feedback control parameter, which can improve the emission characteristics, the fuel consumption characteristics, the drivability characteristics, and the like.

I claim:

1. A method of controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream-side air-fuel ratio sensor, comprising the steps of:

determining whether or not an output of said pull-up type input circuit is lower than a first level which is slightly higher than a rich state level of said pull-up type input circuit after said engine is warmed-up;

determining whether the air-fuel ratio of said engine is rich or lean in accordance which the output of said pull-up type input circuit;

determining that said downstream-side air-fuel ratio sensor is in an activation state when the output of said pull-up type input circuit is lower than said first level and the air-fuel ratio of said engine is rich;

determining whether or not the output of said pull-up type input circuit is lower than a second level lower than said first level;

determining that said downstream-side air-fuel ratio sensor is in an activation state when the output of said pull-up type input circuit is lower than said second level and the air-fuel ratio of said engine is lean; and adjusting an actual air-fuel ratio in accordance with the outputs of said upstream-side and downstream-side air-fuel ratio sensors when said downstream-side air-fuel ratio sensor is in an activation state.

2. A method as set forth in claim 1, wherein said air-fuel ratio determining step comprises the steps of:

determining whether or not a predetermined time has elapsed after the output of said pull-up type input circuit becomes lower than said first level;

determining whether or not the output of said pull-up type input circuit is higher than a third level between said first and second levels after said predetermined time has elapsed, thereby determining that the air-fuel ratio of said engine is rich when the output of said pull-up type input circuit is higher than said third level, and that the air-fuel ratio of said engine is lean when the output of said pull-up type input circuit is not higher than said third level.

3. A method as set forth in claim 1, wherein said air-fuel ratio determining step comprises a step of calculating a variation of the output of said pull-up type input circuit after the output of said pull-up type input circuit becomes lower than said first level, thereby determining that the air-fuel ratio of said engine is lean when said variation is larger than a first predetermined value, and that the air-fuel ratio of said engine is rich when said deviation is smaller than a second predetermined value smaller than said first predetermined value.

4. A method as set forth in claim 3, wherein said deviation is calculated during a predetermined interval after the output of said pull-up type input circuit becomes lower than said first level.

5. A method as set forth in claim 3, wherein said deviation is calculated during two or more successive predetermined intervals.

6. A method as set forth in claim 3, wherein said deviation calculating step comprises the step of:

counting a duration when the output of said pull-up type input circuit is between said first and third levels, thereby determining that said deviation is small when said duration is larger than a first predetermined duration, and that said deviation is large when said second duration is larger than predetermined duration.

7. A method as set forth in claim 1, further comprising the steps of:

determining whether or not the output of said pull-up type input circuit is higher than a fourth level higher than said first level; and determining that said downstream-side air-fuel ratio sensor is in a nonactivation state when the output of said pull-up type input circuit is higher than said fourth level.

8. A method as set forth in claim 1, wherein said pull-up type input circuit comprises:

a resistor connected between an output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

9. A method as set forth in claim 1, wherein said actual air-fuel ratio adjusting step comprises the steps of:

calculating a first air-fuel ratio correction amount in accordance with the output of said upstream-side air-fuel ratio sensor;

calculating a second air-fuel ratio correction amount in accordance with the output of said downstream-side air-fuel ratio sensor; and adjusting said actual air-fuel ratio in accordance with said first and second air-fuel ratio correction amounts.

10. A method as set forth in claim 1, wherein said actual air-fuel ratio adjusting step comprises the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter; and adjusting said actual air-fuel ratio in accordance with said air-fuel ratio correction amount.

11. A method as set forth in claim 10, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

12. A method as set forth in claim 10, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

13. A method as set forth in claim 10, wherein said air-fuel ratio feedback control parameter is determined by a rich delay time for delaying the output of said upstream-side air-fuel ratio sensor switched from the lean side to the rich side and a lean delay time for delaying the output of said upstream-side air-fuel ratio sensor switched from the rich side to the leans side.

14. A method as set forth in claim 10, wherein said air-fuel ratio feedback control parameter is determined by a reference voltage with which the output of said upstream-side air-fuel ratio sensor is compared, thereby determining whether the air-fuel ratio is on the rich side or on the lean side.

15. A method for controlling an air-fuel ratio in an internal combustion engine having a catalyst converter for removing pollutants in the exhaust gas thereof, an air-fuel ratio sensor disposed upstream or downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising the steps of:

determining whether or not an output of said pull-up type input circuit is lower than a first level which is slightly higher rich state level of said pull-up type input after said engine is warmed-up;

determining whether the air-fuel ratio of said engine is rich or lean in accordance with the output of said pull-up type input circuit;

determining that said air-fuel ratio sensor is in an activation state when the output of said pull-up type input circuit is lower than said first level and the air-fuel ratio of said engine is rich;

determining whether or not the output of said pull-up type input circuit is lower than a second level lower than said first level;

determining that said air-fuel ratio sensor is in an activation state when the output of said pull-up type input circuit is lower than said second level, and the air-fuel ratio of said engine is lean; and adjusting an actual air-fuel ratio in accordance with the output of said air-fuel ratio sensor when said air-fuel ratio sensor is in an activation state.

16. A method as set forth in claim 15, wherein said air-fuel ratio determining step comprises the steps of:

determining whether or not a predetermined time has elapsed after the output of said pull-up type input circuit becomes lower than said first level;

determining whether or not the output of said pull-up type input circuit is higher than a third level between said first and second levels after said predetermined time has elapsed, thereby determining that the air-fuel ratio of said engine is rich when the output of said pull-up type input circuit is higher than said third level, and that the air-fuel ratio of said engine is lean when the output of said pull-up type input circuit is not higher than said third level.

17. A method as set forth in claim 15, wherein said air-fuel ratio determining step comprises a step of calculating a variation of the output of said pull-up type input circuit after the output of said pull-up type input circuit becomes lower than said first level, thereby determining that the air-fuel ratio of said engine is lean when said variation is larger than a first predetermined value, and that the air-fuel ratio of said engine is rich when said deviation is smaller than a second predetermine value smaller than said first predetermined value.

18. A method as set forth in claim 17, wherein said deviation is calculated during a predetermined interval after the output of said pull-up type input circuit becomes lower than said first level.

19. A method as set forth in claim 17, wherein said deviation is calculated during two or more successive predetermined intervals.

20. A method as set forth in claim 17, wherein said deviation calculating step comprises the step of:

counting a duration when the output of said pull-up type input circuit is between said first and third levels, thereby determining that said deviation is small when said duration is larger than a first predetermined duration, and that said deviation is large when said duration is larger than a second predetermined duration.

21. A method as set forth in claim 15, further comprising the steps of:

determining whether or not the output of said pull-up type input circuit is higher than a fourth level higher than said first level; and determining that said air-fuel ratio sensor is in a nonactivation state when the output of said pull-up type input circuit is higher than said fourth level.

22. A method as set forth in claim 15, wherein said pull-up type input circuit comprises:

a resistor connected between the output of said air-fuel ratio sensor and a high power supply terminal; and a capacitor connected between the output of said air-fuel ratio sensor and a low power supply terminal, the connection node of said resistor and said capacitor serving as the output of said pull-up type input circuit.

23. A method as set forth in claim 15, wherein said actual air-fuel ratio adjusting step comprises the steps of:

calculating an air-fuel ratio correction amount in accordance with the output of said air-fuel ratio sensor; and adjusting said actual air-fuel ratio in accordance with said air-fuel ratio correction amount.

24. An apparatus for controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream-side air-fuel ratio sensor, comprising:

means for determining whether or not an output of said pull-up type input circuit is lower than a first level which is slightly higher than a rich state level of said pull-up type input circuit after said engine is warmed-up;

means for determining whether the air-fuel ratio of said engine is rich or lean in accordance with the output of said pull-up type input circuit;

means for determining that said downstream-side air-fuel ratio sensor is in an activation state when the output of said pull-up type input circuit is lower than said first level and the air-fuel ratio of said engine is rich;

means for determining whether or not the output of said pull-up type input circuit is lower than a second level lower than said first level;

means for determining that said downstream-side air-fuel ratio sensor is in an activation state when the output of said pull-up type input circuit is lower than said second level, and the air-fuel ratio of said engine is lean; and means for adjusting an actual air-fuel ratio in accordance with the outputs of said upstream-side and downstream-side air-fuel ratio sensors when said downstream-side air-fuel ratio sensor is in an activation state.

25. An apparatus as set forth in claim 24, wherein said air-fuel ratio determining means comprises:

means for determining whether or not a predetermined time has elapsed after the output of said pull-up type input circuit becomes lower than said first level;

means for determining whether or not the output of said pull-up type input circuit is higher than a third level between said first and second levels after said predetermined time has elapsed, thereby determining that the air-fuel ratio of said engine is rich when the output of said pull-up type input circuit is higher than said third level, and that the air-fuel ratio of said engine is lean when the output of said pull-up type input circuit is not higher than said third level.

26. An apparatus as set forth in claim 24, wherein said air-fuel ratio determining means comprises means for calculating a variation of the output of said pull-up type input circuit after the output of said pull-up type input circuit becomes lower than said first level, thereby determining that the air-fuel ratio of said engine is lean when said variation is larger than a first predetermined valve, and that the air-fuel ratio of said engine is rich when said deviation is smaller than a second predetermined valve smaller than said first predetermined valve.

27. An apparatus as set forth in claim 26, wherein said deviation is calculated during a predetermined interval after the output of said pull-up type input circuit becomes lower than said first level.

28. An apparatus as set forth in claim 26, wherein said deviation is calculated during two or more successive predetermined intervals.

29. An apparatus as set forth in claim 26, wherein said deviation calculating means comprises:

means for counting a duration when the output of said pull-up type input circuit is between said first and third levels, thereby determining that said deviation is small when said duration is larger than a first predetermined duration, and that said deviation is large when said duration is larger than a second predetermined duration.

30. An apparatus as set forth in claim 24, further comprising:

means for determining whether or not the output of said pull-up type input circuit is higher than a fourth level higher than said first level; and means for determining that said downstream-side air-fuel ratio sensor is in a non-activation state when the output of said pull-up type input circuit is higher than said fourth level.

31. An apparatus as set forth in claim 24, wherein said pull-up type input circuit comprises:

a resistor connected between an output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

32. An apparatus as set forth in claim 24, wherein said actual air-fuel ratio adjusting means comprises:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor; and means for adjusting said actual air-fuel ratio in accordance with said first and second air-fuel ratio correction amounts.

33. An apparatus as set forth in claim 24, wherein said actual air-fuel ratio adjusting means comprises:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter; and means for adjusting said actual air-fuel ratio in accordance with said air-fuel ratio correction amount.

34. An apparatus as set forth in claim 33, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

35. An apparatus as set forth in claim 33, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

36. An apparatus as set forth in claim 33, wherein said air-fuel ratio feedback control parameter is determined by a rich delay time for delaying the output of said upstream-side air-fuel ratio sensor switched from the lean side to the rich side and a lean delay time for delaying the output of said upstream-side air-fuel ratio sensor switched from the rich side to the lean side.

37. An apparatus as set forth in claim 33, wherein said air-fuel ratio feedback control parameter is determined by a reference voltage with which the output of said upstream-side air-fuel ratio sensor is compared, thereby determining whether the air-fuel ratio is on the rich side or on the lean side.

38. An apparatus for controlling an air-fuel ratio in an internal combustion engine having a catalyst converter for removing pollutants in the exhaust gas thereof, an air-fuel ratio sensor disposed upstream or downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising:

means for determining whether or not an output of said pull-up type input circuit is lower than a first level which is slightly higher rich state level of said pull-up type input after said engine is warmed-up;

means for determining whether the air-fuel ratio of said engine is rich or lean in accordance with the output of said pull-up type input circuit;

means for determining that said air-fuel ratio sensor is in an activation state when the output of said pull-up type input circuit is lower than said first level and the air-fuel ratio of said engine is rich;

means for determining whether or not the output of said pull-up type input circuit is lower than a second level lower than said first level;

means for determining that said air-fuel ratio sensor is in an activation state when the output of said pull-up type input circuit is lower than said second level, and the air-fuel ratio of said engine is lean; and means for adjusting an actual air-fuel ratio in accordance with the output of said air-fuel ratio sensor when said air-fuel ratio sensor is in an activation state.

39. An apparatus as set forth in claim 38, wherein said air-fuel ratio determining means comprises:

means for determining whether or not a predetermined time has elapsed after the output of said pull-up type input circuit becomes lower than said first level;

means for determining whether or not the output of said pull-up type input circuit is higher than a third level between said first and second levels after said predetermined time has elapsed, thereby determining that the air-fuel ratio of said engine is rich when the output of said pull-up type input circuit is higher than said third level, and that the air-fuel ratio of said engine is lean when the output of said pull-up type input circuit is not higher than said third level.

40. An apparatus as set forth in claim 38, wherein said air-fuel ratio determining means comprises means for calculating a variation of the output of said pull-up type input circuit after the output of said pull-up type input circuit becomes lower than said first level, thereby determining that the air-fuel ratio of said engine is lean when said variation is larger than a first predetermined value, and that the air-fuel ratio of said engine is rich when said deviation is smaller than a second predetermined value smaller than said first predetermined value.

41. An apparatus as set forth in claim 40, wherein said deviation is calculated during a predetermined interval after the output of said pull-up type input circuit becomes lower than said first level.

42. An apparatus as set forth in claim 40, wherein said deviation is calculated during two or more successive predetermined intervals.

43. An apparatus as set forth in claim 40, wherein said deviation calculating means comprises:

means for counting a duration when the output of said pull-up type input circuit is between said first and third levels, thereby determining that said deviation is small when said duration is larger than a first predetermined duration, and that said deviation is large when said duration is larger than a second predetermined duration.

44. An apparatus as set forth in claim 38, further comprising:

means for determining whether or not the output of said pull-up type input circuit is higher than a fourth level higher than said first level; and means for determining that said air-fuel ratio sensor is in a nonactivation state when the output of said pull-up type input circuit is higher than said fourth level.

45. An apparatus as set forth in claim 38, wherein said pull-up type input circuit comprises:

a resistor connected between the output of said air-fuel ratio sensor and a high power supply terminal; and a capacitor connected between the output of said air-fuel ratio sensor and a low power supply terminal, the connection node of said resistor and said capacitor serving as the output of said pull-up type input circuit.

46. An apparatus as set forth in claim 38, wherein said actual air-fuel ratio adjusting means comprises:

means for calculating an air-fuel ratio correction amount in accordance with the output of said air-fuel ratio sensor; and means for adjusting said actual air-fuel ratio in accordance with said air-fuel ratio correction amount.

* * * * *